US012201205B2

(12) United States Patent
El Hassain et al.

(10) Patent No.: US 12,201,205 B2
(45) Date of Patent: Jan. 21, 2025

(54) ASSEMBLY FORMING A CAP FOR A COSMETIC PRODUCT CONTAINER COMPRISING TWO ELEMENTS AND RELEASE MEANS

(71) Applicant: QUALIPAC, Clichy (FR)

(72) Inventors: Alim El Hassain, Saint Ouen (FR); Pierre Dehe, Paris (FR)

(73) Assignee: QUALIPAC, Clichy (FR)

( * ) Notice: Subject to any disclaimer, the term of this patent is extended or adjusted under 35 U.S.C. 154(b) by 175 days.

(21) Appl. No.: 17/792,970

(22) PCT Filed: Mar. 3, 2020

(86) PCT No.: PCT/FR2020/050422
§ 371 (c)(1),
(2) Date: Jul. 14, 2022

(87) PCT Pub. No.: WO2021/148724
PCT Pub. Date: Jul. 29, 2021

(65) Prior Publication Data

US 2023/0048650 A1 Feb. 16, 2023

(30) Foreign Application Priority Data

Jan. 24, 2020 (FR) ..... 2000696

(51) Int. Cl.
*A45D 40/00* (2006.01)
*A45D 34/00* (2006.01)
(Continued)

(52) U.S. Cl.
CPC ..... *A45D 34/00* (2013.01); *A45D 40/00* (2013.01); *A45D 2034/002* (2013.01);
(Continued)

(58) Field of Classification Search
CPC .. A45D 34/00; A45D 40/00; A45D 2034/002; A45D 2034/007;
(Continued)

(56) References Cited

U.S. PATENT DOCUMENTS

| | | | | |
|---|---|---|---|---|
| 6,877,172 | B2 * | 4/2005 | Malek | E03C 1/0404 4/678 |
| 8,210,572 | B2 * | 7/2012 | Davis | F16L 37/004 285/9.1 |
| 8,556,527 | B1 * | 10/2013 | Chou | A45D 40/04 401/98 |
| 2004/0135009 | A1 * | 7/2004 | Malek | E03C 1/0404 239/530 |
| 2011/0073601 | A1 * | 3/2011 | Komatsuda | A45D 40/18 220/230 |

(Continued)

FOREIGN PATENT DOCUMENTS

| | | | |
|---|---|---|---|
| FR | 3082405 | A1 | 12/2019 |
| GB | 2276868 | A | 10/1994 |
| KR | 200475325 | Y1 | 11/2014 |

*Primary Examiner* — Gideon R Weinerth
(74) *Attorney, Agent, or Firm* — H&I PARTNERS; Chai Im; C. Andrew Im

(57) ABSTRACT

A housing for cosmetic product(s), including at least one base to receive a cosmetic product and a mirror-bearing lid which is articulated with respect to the base by means of a hinge. A spacer plate connected to the base and including at least one through-opening passing through the thickness thereof so as to form a compartment directly surrounding the cosmetic product. The hinge includes a first upper pivot that is as one with the mirror-bearing lid, a pivot pin for the hinge, and a second lower pivot that is connected to the spacer plate so as to form the hinge. The pivots and the pivot pin are removably connectable to each other such that the mirror-bearing lid can be detached from the base and repositioned thereon as desired.

12 Claims, 25 Drawing Sheets

(51) Int. Cl.
*B65D 41/02* (2006.01)
*B65D 43/02* (2006.01)

(52) U.S. Cl.
CPC ..... *A45D 2034/007* (2013.01); *A45D 2040/0006* (2013.01); *A45D 2040/0012* (2013.01); *A45D 2200/00* (2013.01)

(58) Field of Classification Search
CPC .... A45D 2040/0006; A45D 2040/0012; A45D 2200/00; B65D 2313/04; F16B 11/008; F16B 13/06; F16B 13/0858
USPC ..... 24/547, 563; 206/581; 285/9.1; 439/336, 345, 350, 352, 357
See application file for complete search history.

(56) References Cited

U.S. PATENT DOCUMENTS

| | | | | |
|---|---|---|---|---|
| 2017/0196339 | A1* | 7/2017 | Kim | A45D 40/06 |
| 2018/0290794 | A1* | 10/2018 | Duquet | B65D 45/02 |
| 2019/0053603 | A1* | 2/2019 | Kamitani | A45D 40/06 |
| 2019/0093337 | A1* | 3/2019 | Cabaj | E04B 1/4157 |
| 2019/0239618 | A1* | 8/2019 | Wolfe | B65D 51/32 |
| 2019/0263568 | A1* | 8/2019 | De Rosa | B65D 41/023 |
| 2021/0085058 | A1* | 3/2021 | Oh | A45D 40/06 |
| 2021/0145149 | A1* | 5/2021 | Lin | A45D 34/046 |
| 2023/0002123 | A1* | 1/2023 | Lin | A45D 40/00 |
| 2023/0007918 | A1* | 1/2023 | Asmir | A45D 40/02 |
| 2024/0083639 | A1* | 3/2024 | Chen | B65D 51/245 |

* cited by examiner

ASSEMBLY FORMING A CAP FOR A COSMETIC PRODUCT CONTAINER COMPRISING TWO ELEMENTS AND RELEASE MEANS

RELATED APPLICATIONS

This application is a § 371 application of PCT/FR2020/050422 filed Mar. 3, 2020, which claims priority from French Patent Application No. 2000696 filed Jan. 24, 2020, each of which is incorporated herein by reference in its entirety.

TECHNICAL FIELD OF THE INVENTION

The present invention relates to an assembly forming a cap for a cosmetic product container including two elements and release means. It applies in particular to perfume bottles or to any type of container for cosmetic products.

BACKGROUND OF THE INVENTION

It is common in the prior art to provide perfume bottles with a decorative cap which can, for example, cover or enclose a device for diffusing fluid (liquid, cream) by projection (under pressure or by manual mechanical pump, for example). These caps are generally either irremovable, or the elements which constitute them are made in such a manner that they are difficult to recycle. They are therefore discarded, with the consequences that can be imagined.

There are therefore many drawbacks to making the current caps from a design, manufacturing and especially ecological and economic point of view.

OBJECT AND SUMMARY OF THE INVENTION

The present invention aims at overcoming these drawbacks with an approach which is totally innovative, particularly compact and easy to use, allowing designing any type of cap, in numerous shapes and a multiplicity of materials.

To this end, according to a first aspect, the present invention relates to an assembly forming a cap for a cosmetic product container, said assembly having a longitudinal axis along which there extend a first element intended to be mounted on the container and a second element detachably assembled around the first element, characterized in that:

- the first element includes tabs which are radially elastically deformable for assembling/disassembling the second element on the first element, said tabs cooperating, in the assembled position, with notches formed inside the second element, and
- said assembly also includes additional release means which is movable between a first end position in which the tabs of the first element are engaged with the notches of the second element for assembling the first and second elements, and a second end position in which said tabs are disengaged radially from said notches for disassembling the first and second elements.

The invention is implemented according to the embodiments and variants set out below, which are to be considered individually or according to any technically effective combination.

According to a first embodiment, the additional release means is a member having magnetic properties which is adapted to be displaced under the effect of a determined external magnetic field, said element having magnetic properties being axially movable between a first rest position when it is placed outside the magnetic field and a second active position to disengage the tabs from the notches when it is placed in said magnetic field.

Preferably, the radially elastically deformable tabs respectively have peripheral end hooks adapted to penetrate into the notches of the second element, and the member having magnetic properties is a ring-shaped magnet disposed around central fingers which are secured to said tabs and having a conical outer surface, said fingers bringing together said tabs radially in the direction of the longitudinal axis when the magnet passes from the rest position to the active position, thus causing the disengagement of the hooks out from the notches.

Advantageously, the central fingers, the notches and the radially elastically deformable tabs are three in number and are evenly angularly distributed.

According to a second embodiment, the additional release means is an axially movable tool exclusively inside the first element between a first rest position and a second active position to disengage the tabs from the notches.

According to a particular embodiment of the present invention, the radially elastically deformable tabs have respectively, at the free ends thereof, peripheral hooks adapted to penetrate into the notches of the second element, the tabs being secured to a wall of the first element being reduced in the direction of said tabs, and the axially movable tool is a rod provided, at one working end, with radial pushers, the axial displacement of the tool along the inner wall of the first element causing the radial spacing of the tabs by the pushers and the disengagement of the hooks out from the notches.

Advantageously, the first element includes, along the inner wall thereof, grooves for inserting and axially guiding the pushers of the tool towards the hooks.

Preferably, the pushers, the notches and the radially elastically deformable tabs are three in number and are evenly angularly distributed.

According to a third embodiment of the present invention, the first element includes an internal thread and the additional release means is a rod provided with an external thread, said rod being axially movable and in rotation along/about the axis inside the first element between a first rest position and a second active position in which the respective threads are engaged to gradually disengage the tabs from the notches of the second element as the screwing of the rod into the first element progresses.

According to a complementary aspect, the rod is further provided with an enlarged end head intended to bear against a conical inner wall of the first element carrying the radially elastically deformable tabs, said tabs being radially spaced apart from each other exclusively under the effect of the action of the enlarged head on said inner wall as the screwing of the rod into the first element progresses.

According to a particularly interesting aspect of the present invention, the tabs are spaced apart from each other exclusively under the effect of the penetration into each other of the respective threads as the screwing of the rod into the first element progresses.

According to a preferred feature, the notches are blind housings.

According to a variant, the notches are through holes.

BRIEF DESCRIPTION OF FIGURES

Other advantages, aims and features of the present invention emerge from the following description made, for explanatory and not limiting purposes, with reference to the appended drawings, in which.

DESCRIPTION OF EMBODIMENTS

Figure 1:
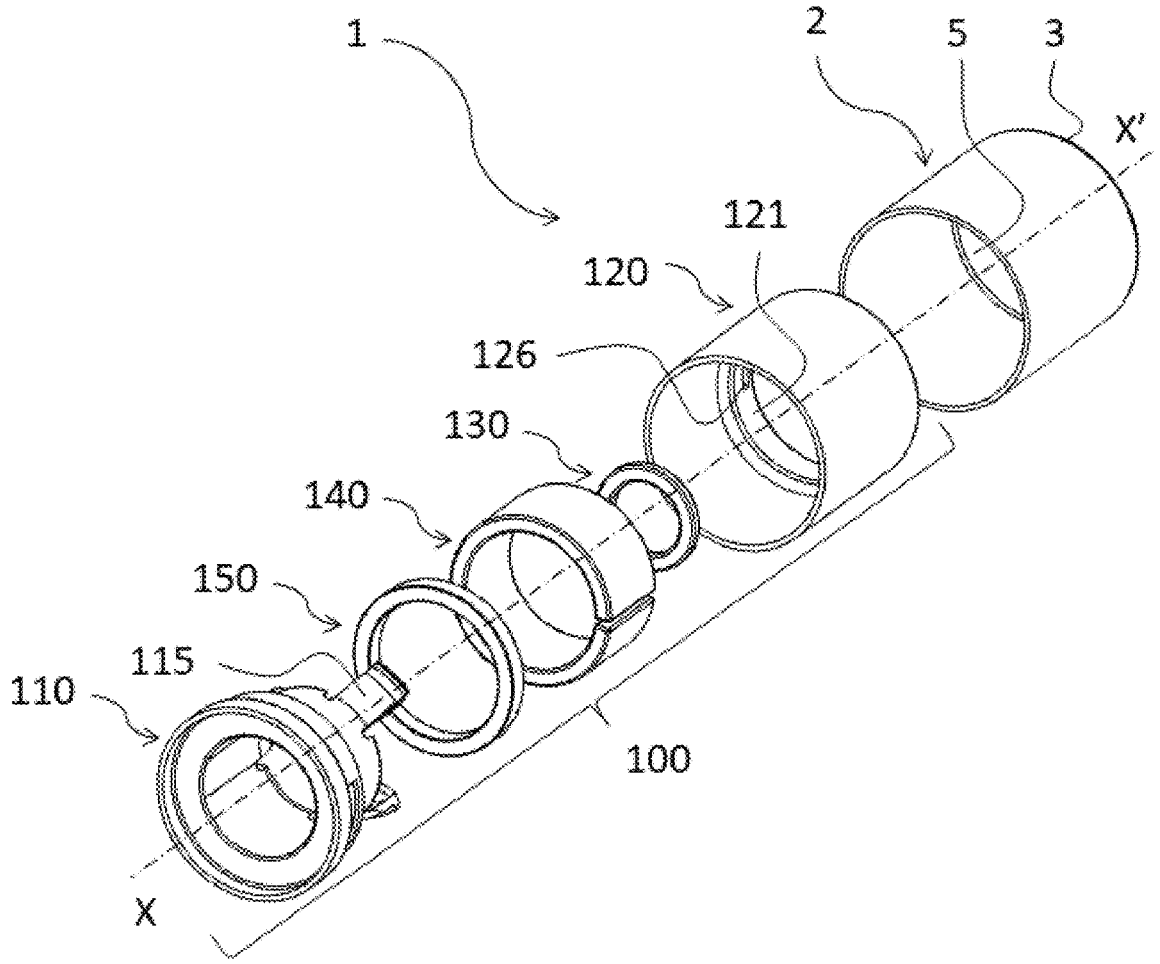
FIG. 1 is an exploded perspective view of a first embodiment of a cosmetic product bottle cap including an assembly in accordance with the present invention in a disassembled position.
Figure 2:
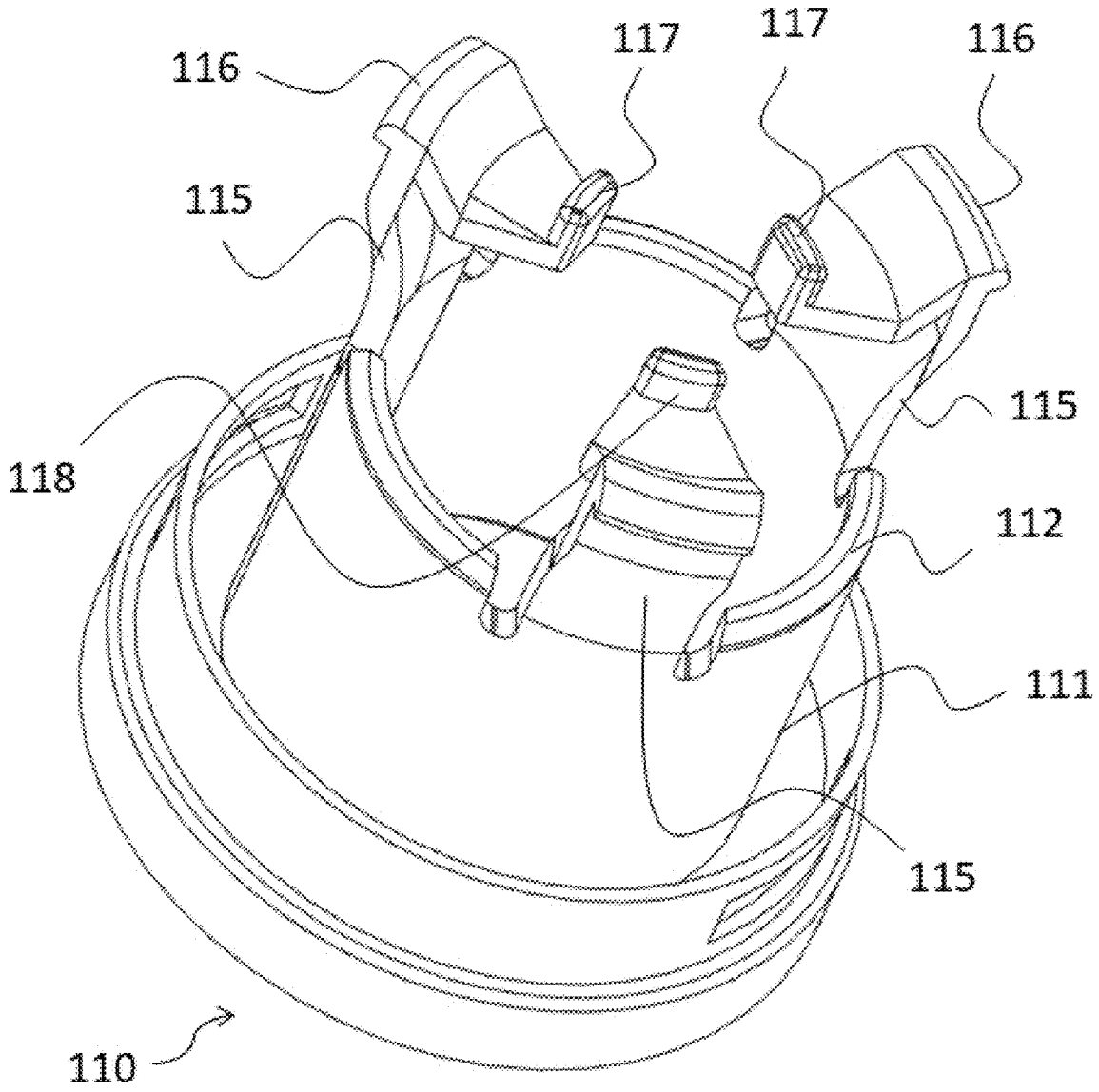
FIG. 2 is a perspective detail view of a first element of FIG. 1.

FIGS. 1 to 5 represent a first embodiment of an assembly 1 including an assembly 100 in accordance with the present invention.

According to this first mode, this assembly 1 includes an outer decorative cover 2, for example a (recyclable) aluminum cylinder of small thickness and closed by a wall 5 at an upper end 3, which is mounted (preferably with a very small clearance) on an assembly 100 including a first element/insert 110, for example made of recyclable plastic material, preferably bio-sourced, connected to a second element/insert 120, for example made of (recyclable) aluminum, and additional release means 130.

The cover 2 and the different portions 110, 120 and 130 of the assembly 100 extending along a common longitudinal axis XX'.

The first element 110 generally includes a main body 111 of essentially cylindrical shape extending along the axis XX' provided, at an upper rim 112, with three radially elastically deformable tabs 115 each provided with a end hook 116 protruding radially away from the axis XX'. The tabs 115 are evenly distributed (that is to say at 120°) over the periphery of the first element 110 and are spaced from each other by a longitudinal slot allowing the aforementioned elastic radial deformation.

The second element 120 (see FIG. 4) has, in turn, the overall shape of a hollow cylinder 121 extending along the axis XX' and including an upper edge 122 provided, on the inner periphery thereof, with blind notches 126 (three in number in the present case) which are evenly angularly distributed over the circumference of the edge 122 (that is to say at 120° from each other). It will be understood by observing the figures that the notches 126 are intended to be placed opposite to the hooks 116 in the assembled position of the elements 110 and 120.

Figure 5:
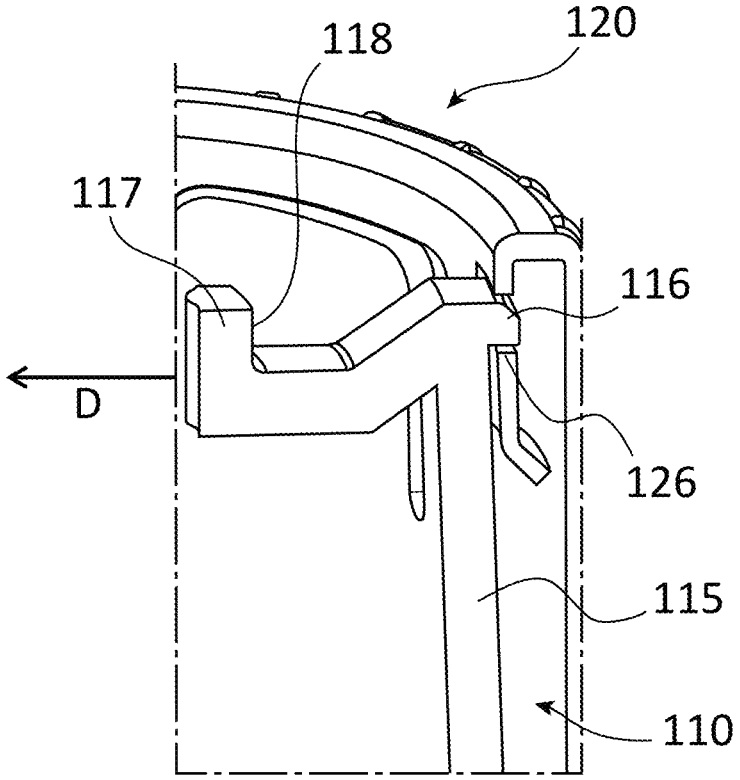
FIG. 5 is a longitudinal partial sectional view of the two elements of FIGS. 2 and 4 in an assembled position.
Figure 6:
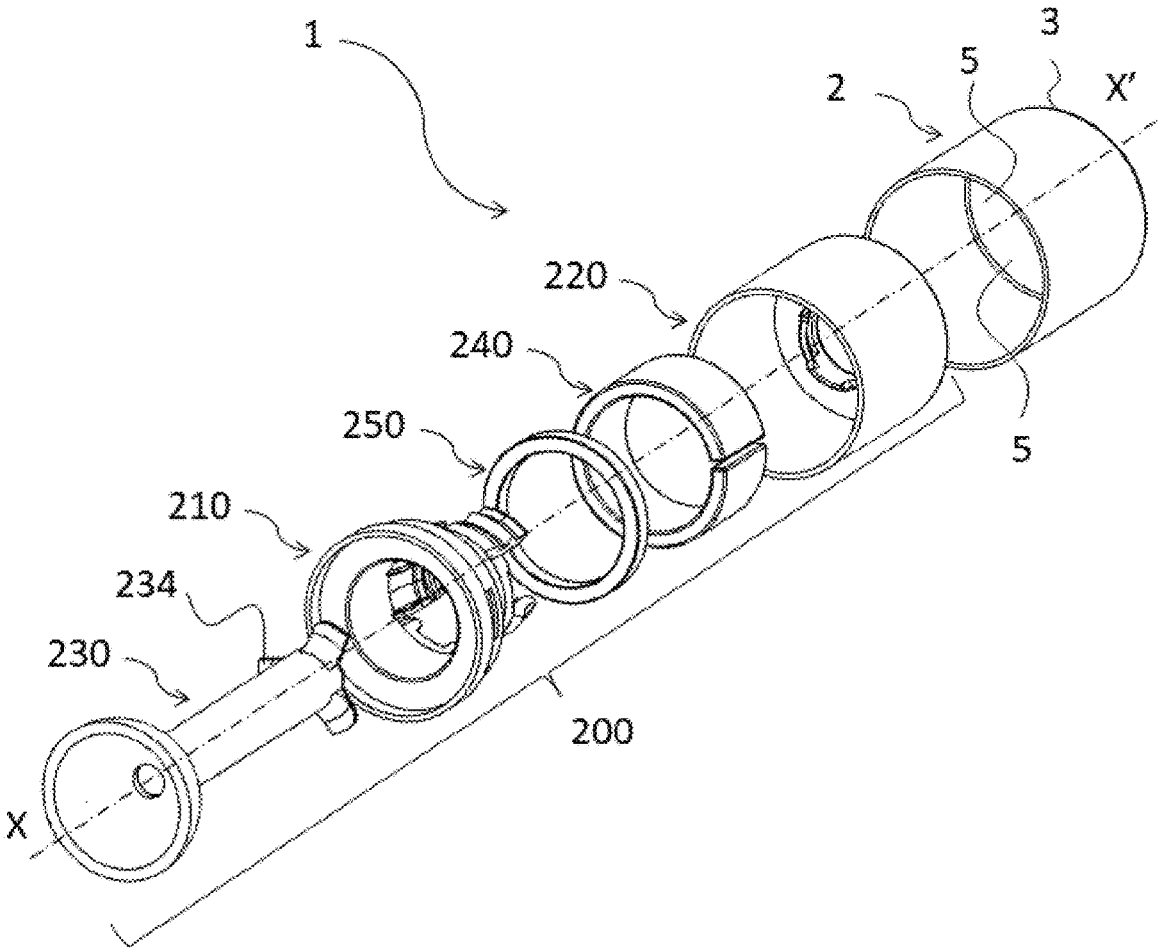
FIG. 6 is an exploded perspective view of a second embodiment of the invention.
Figure 7:
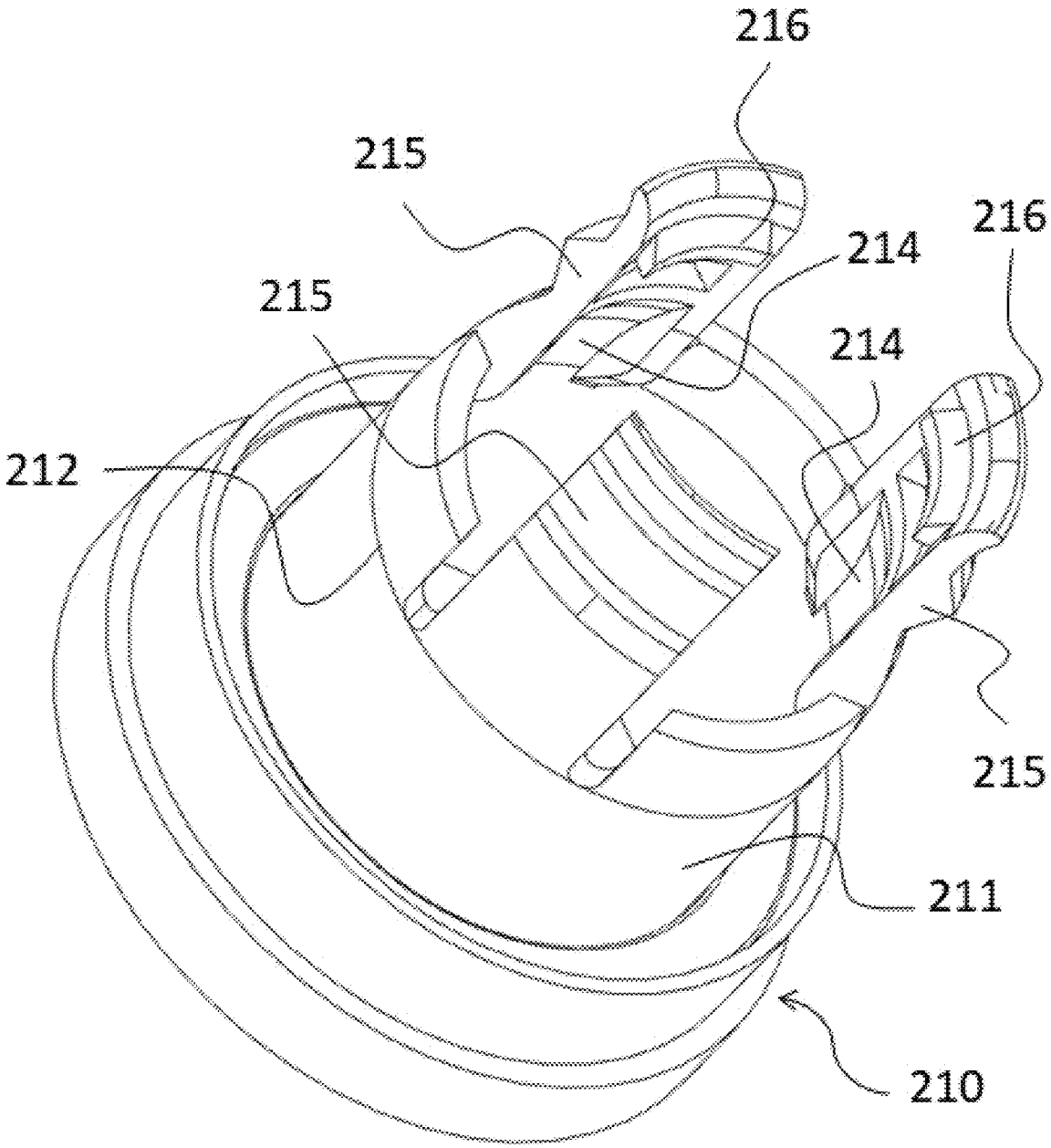
FIG. 7 is a perspective detail view of a first element of FIG. 6.
Figure 8:
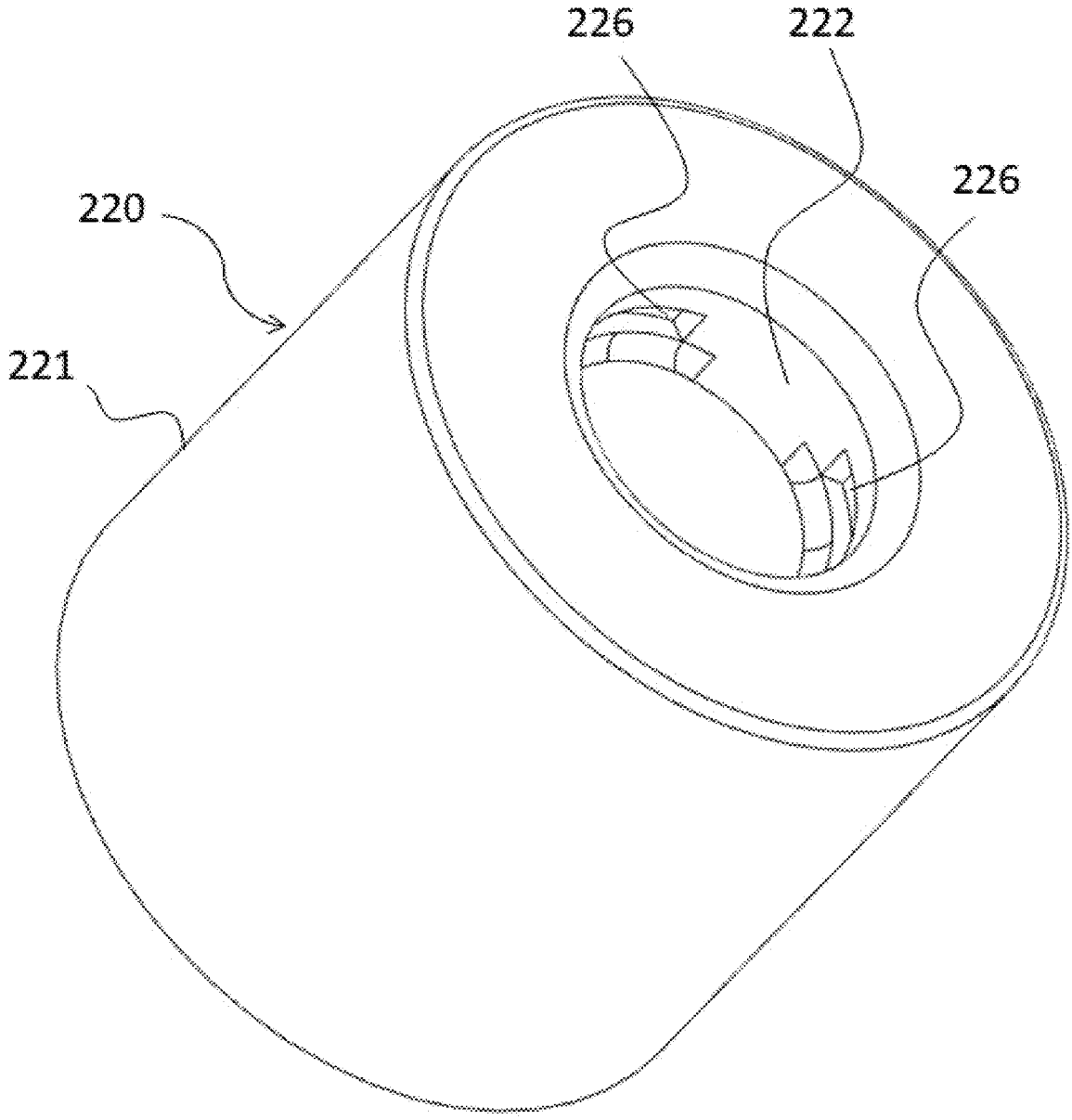
FIG. 8 is a perspective detail view of a second element of FIG. 6.
Figure 9:
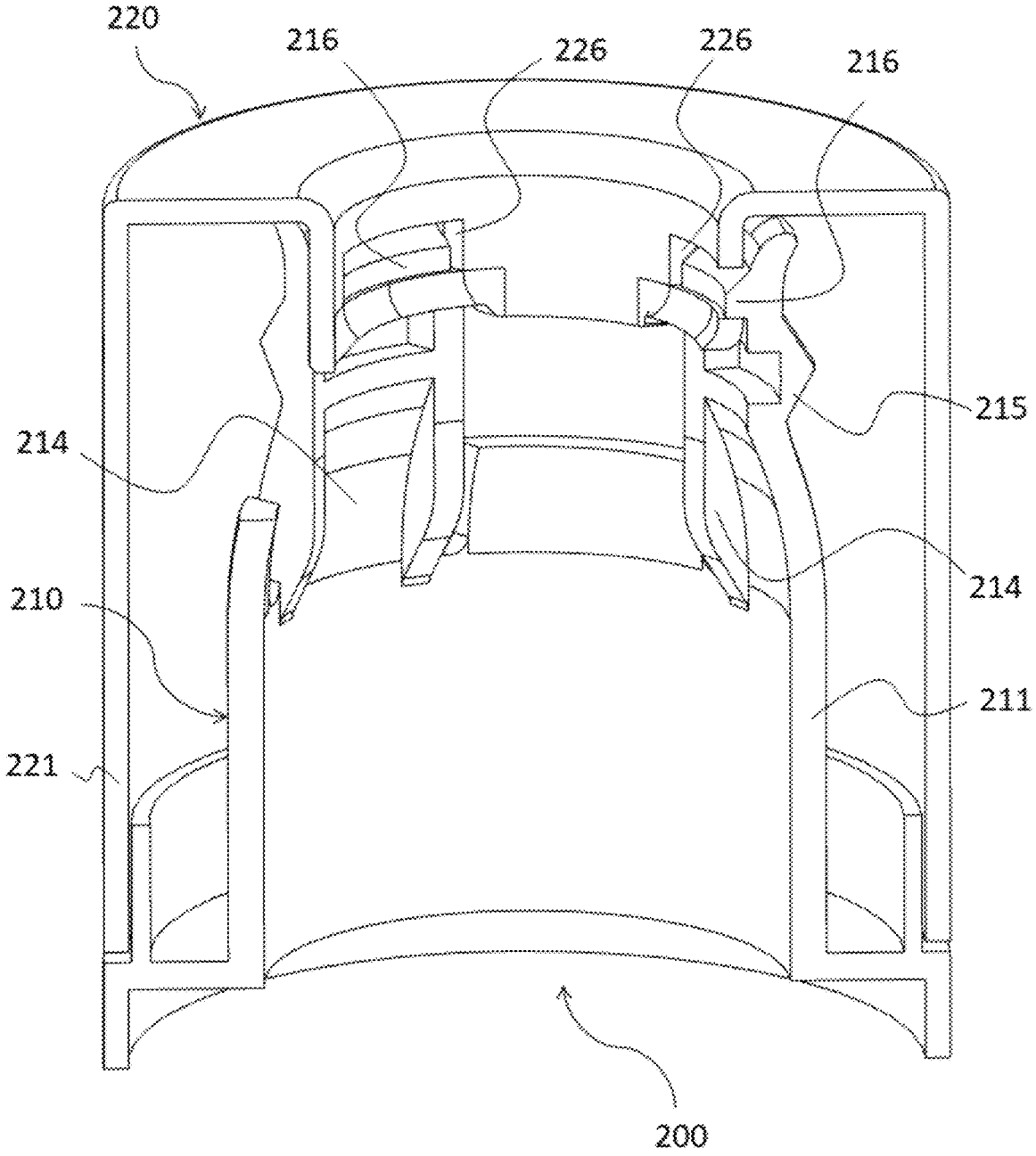
FIG. 9 is a longitudinal sectional view of the two elements of FIGS. 7 and 8 in an assembled position.

More specifically, in the assembled position of the two elements 110 and 120 represented in FIG. 5, the end hooks 116 of the radially elastically deformable tabs 115 penetrate into the notches 165 of the second element 120 such that the two elements are inseparable. The cover 2 is, in turn, added around the second element 120.

Figure 3:
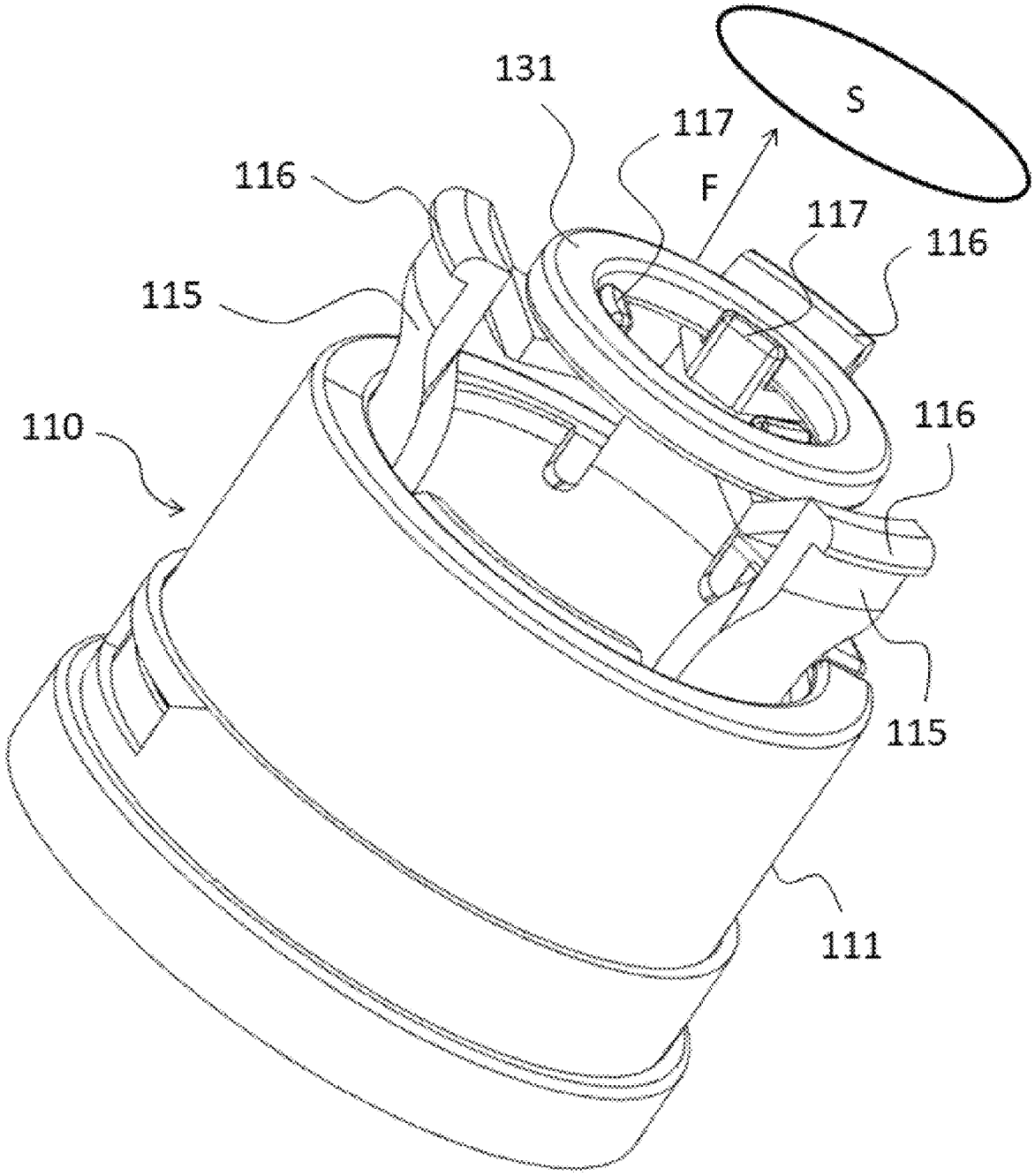
FIG. 3 is another more complete detailed perspective view of the first element of FIG. 1.
Figure 4:
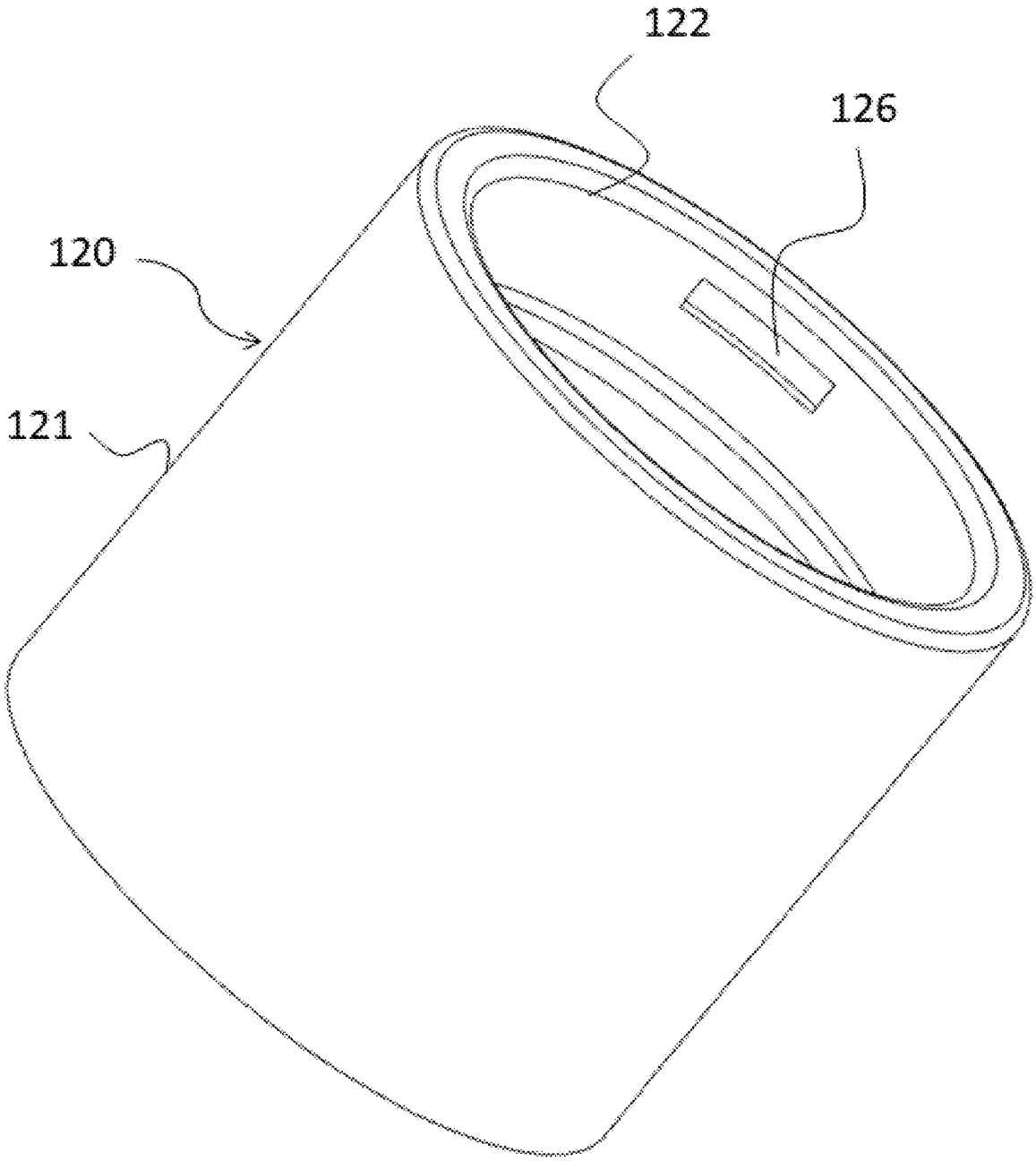
FIG. 4 is a perspective detail view of a second element of FIG. 1.

The assembly 100 of FIGS. 1 to 5 also includes additional release means 130 (see FIG. 1) in the form of a member having magnetic properties, for example a magnet 131 (see FIG. 3). This additional release means 130 is movable between a first end position in which the hooks 116 of the tabs 115 of the first element 110 are engaged with the notches 126 of the second element 120 for assembling the first and second elements together, and a second end position in which said tabs 115 are disengaged radially from said notches 126 for disassembling the first and second elements.

In the present case, the magnet 131 takes the form of a ring which locally surrounds protrusions 117 belonging to the radially elastically deformable tabs 115 and axially erected away from the upper rim 112 so as to keep the latter close to the main axis of the assembly (assembled position). To this end, these three protrusions 117 each have an outer surface 118 together forming a conical profile which widens as one moves axially away from the rim 112.

Thus, when the magnet 131 is displaced axially along the arrow F, under the effect of an external magnetic field S of a suitable strength, from its rest position (hooks 116 engaged in the notches 126) moving away from the rim 112 of the first element 110, it gradually radially tightens the protrusions 117 as it travels through the conical outer shape 118 of the latter, which gradually disengages the hooks 116 from the notches 126 of the second element thanks to the radial elasticity of the tabs 115 (more specifically, the hooks 116 approach together the axis XX'). Once the hooks 116 have been completely disengaged, the two elements 110 and 120 can be completely released to be recycled individually according to their construction material, which allows an easy and total recycling of the assembly 1 as a whole.

The assembly also includes a weight element 140 intended to weigh it down (sensation of perceived quality and better adhesion) disposed between the first element 110 and the second element 120 (see FIG. 3), and being in the form of a cylindrical metal mass with annular section extending along the axis XX'.

A second magnet 150, of the annular type, is also provided (FIG. 1) between the first element 110 and the second element 120, under the weight element 140, to allow, for example, removably fastening the assembly 1 or just the assembly 2 on a prominent device for spraying perfume, for example of the pump or gas type, this in order to form an aesthetic cover over said sprayer.

FIGS. 6 to 11 represent a second embodiment of an assembly 200 in accordance with the present invention.

In this embodiment, the assembly 1 includes a cover 2 and an assembly 200 comprising a first internal element 210, a second external element 220, additional means 230 for releasing the two elements from each other, a weight element 240 and a magnet 250 for removable fastening, these last two portions being similar to their equivalents of the previous embodiment.

The first element 210 generally includes a main body 211 of an essentially cylindrical shape extending along the axis XX' provided, at an upper rim 212, with three radially elastically deformable tabs 215 each provided with an end hook 216 protruding radially away from the axis XX'. The tabs 215 are evenly distributed (that is to say at 120°) over the periphery of the first element 210 and are spaced from each other by a longitudinal slot allowing the aforementioned elastic radial deformation.

The second element 220 (see FIG. 8) has, in turn, the overall shape of a hollow cylinder 221 extending along the axis XX' and including an upper edge 222 provided, on the inner periphery thereof, with blind notches 226 (three in number in the present case) which are evenly angularly distributed over the circumference of the edge 222 (that is to say at 120° from each other). Herein again, it will be easily understood by observing the figures that the notches 226 are intended to be placed opposite to the hooks 216 in the assembled position of the elements 210 and 220.

Thus, as in the first embodiment, in the assembled position of the assembly 200, the radially elastically deformable tabs 215 are in an unconstrained rest position such that the hooks 216 penetrate radially into the notches 226. The first and second elements therefore cannot be separated except by forcing them and breaking them.

The cover 2 comes, in turn, fit around the second element 220.

Figure 10:
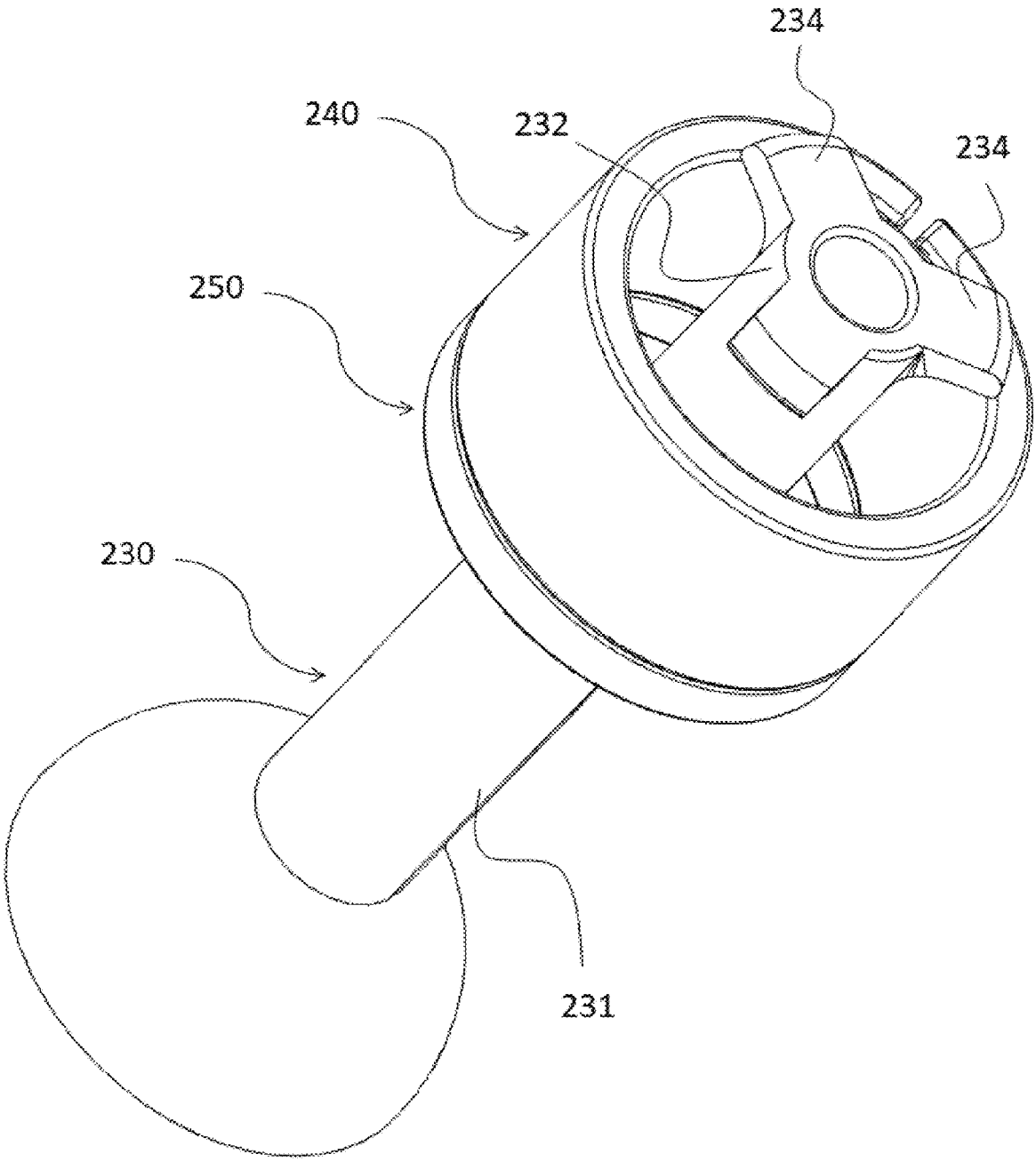
FIG. 10 is a perspective detail view representing in particular additional release means of FIG. 6.
Figure 11:
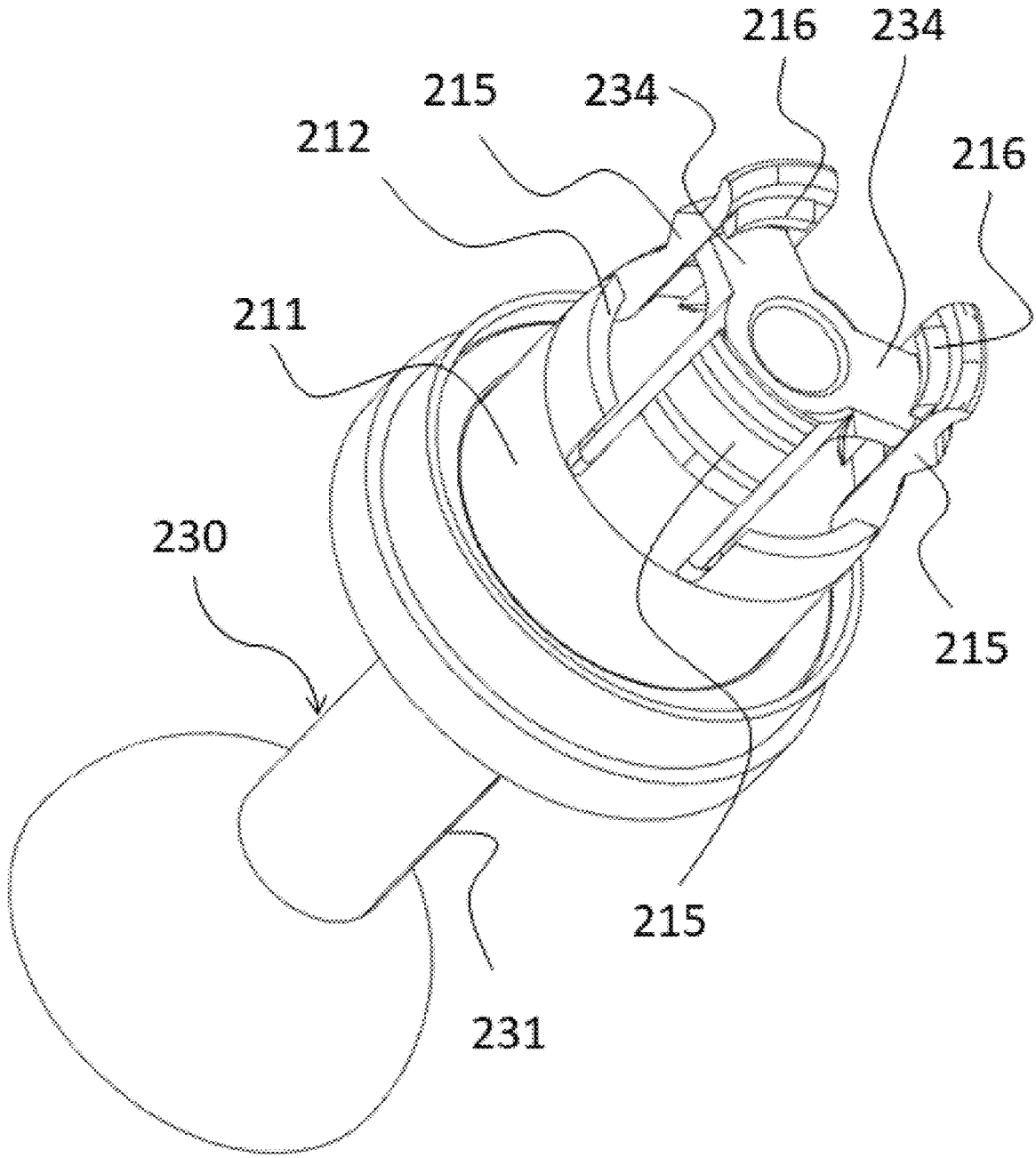
FIG. 11 is a perspective detail view of the additional release means of FIG. 10 inserted into the first element of FIG. 7.
Figure 12:
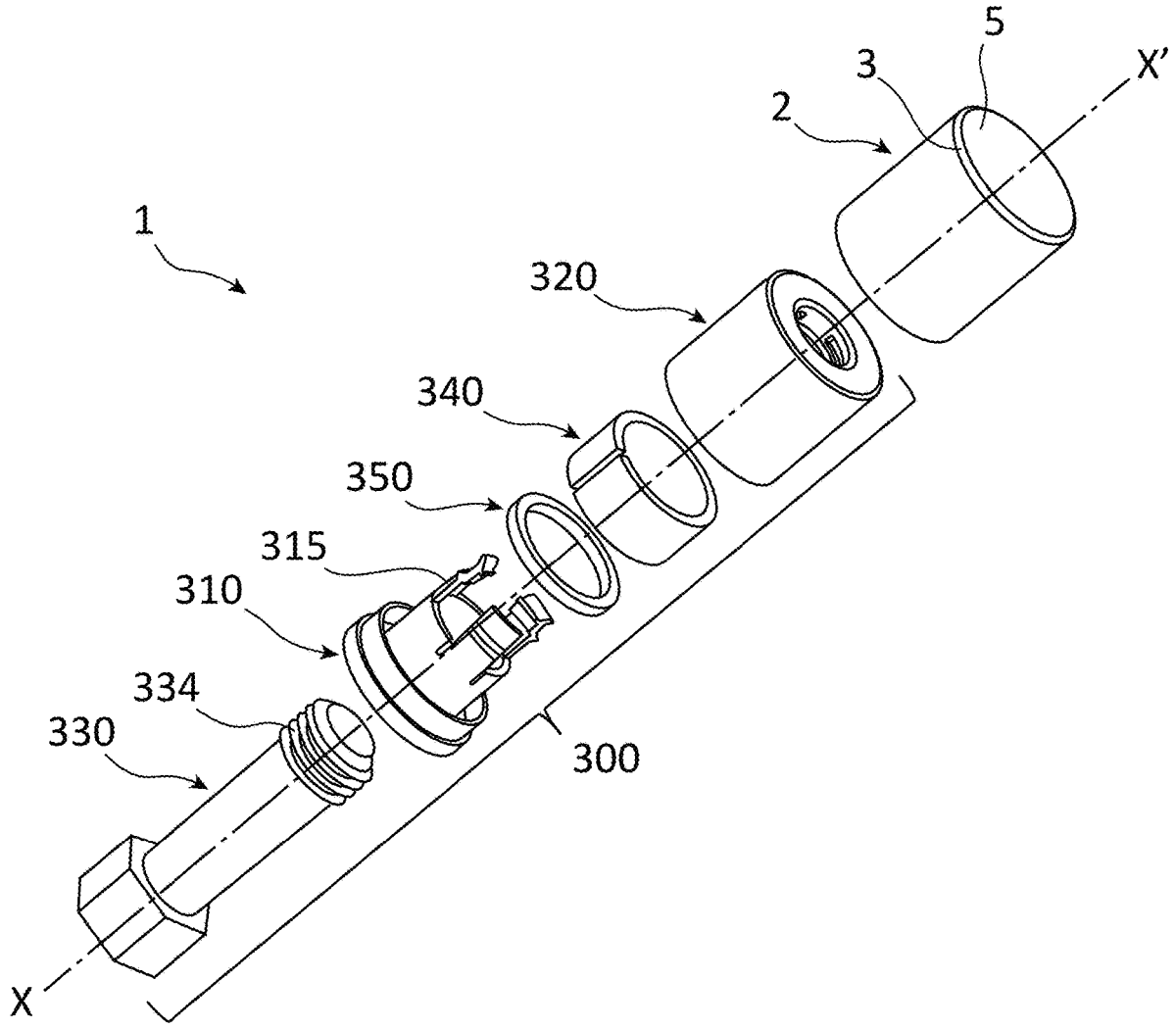
FIG. 12 is an exploded perspective view of a third embodiment of an assembly in accordance with the present invention.

In accordance with FIG. 10, the additional release means 230 herein takes the form of a rod 231 provided, at an upper or distal end 232 (opposite to the proximal end called "handling" proximal end, for example manual or mechanical), with a prominent head provided with three radial protrusions 234 233 arranged at 120° from each other.

The interior of the first element 210 includes, at each of the radially elastically deformable tabs 215, three of the longitudinal grooves 214 having a conical shape narrowing slightly as approaching the hooks 116, which are intended to receive the radial protuberances 234 of the additional release means 230.

The operation of this assembly 200 is as follows.

The rod 231 of the additional release means 230 is inserted axially (manually or mechanically) inside the first element 210, and the radial protrusions 234 gradually penetrate into the internal grooves 214. The inside of the first element 210 being slightly conical at said grooves 214, the protuberances 234 gradually move apart the radially elastically deformable tabs 215 as the rod 231 advances axially (FIG. 11), such that the hooks 216 are radially disengaged from the notches 226, thus releasing the second element 220 from the first element 210. As previously, it is then possible to separately recycle each of the portions of the assembly 200 and the cover according to the nature of the materials which constitute them.

FIGS. 12 to 18 represent a third embodiment of an assembly 300 in accordance with the present invention.

This variant, as in the preceding examples, the assembly 1 includes a cover 2 which is intended to cover an assembly 300 comprising a first element 310 forming a plastic insert intended to be assembled with a second element 320 made of recyclable aluminum.

As previously, the first element 310 includes a shape of a longitudinal cylinder 311 extending along the axis XX' and has, at a rim 312, radially elastically deformable tabs 315 (see FIG. 13) each provided with an end hook 316 projecting radially away from the axis XX'. The tabs 315 are evenly distributed (that is to say at 120°) over the periphery of the first element 310 and are spaced from each other by a longitudinal slot allowing the aforementioned elastic radial deformation The second element 320 comprises, in turn, (see FIG. 14) a cylindrical body 321 provided with an upper rim 322 provided with notches 326 316 evenly angularly distributed on the periphery thereof. As in the preceding case, the notches 126 are three in number and evenly angularly distributed over the circumference of the rim edge 322 (that is to say at 120° from each other). It will be understood by observing the figures that the notches 326 are intended to be placed opposite to the hooks 316 in the assembled position of the elements 310 and 320.

Figure 13:
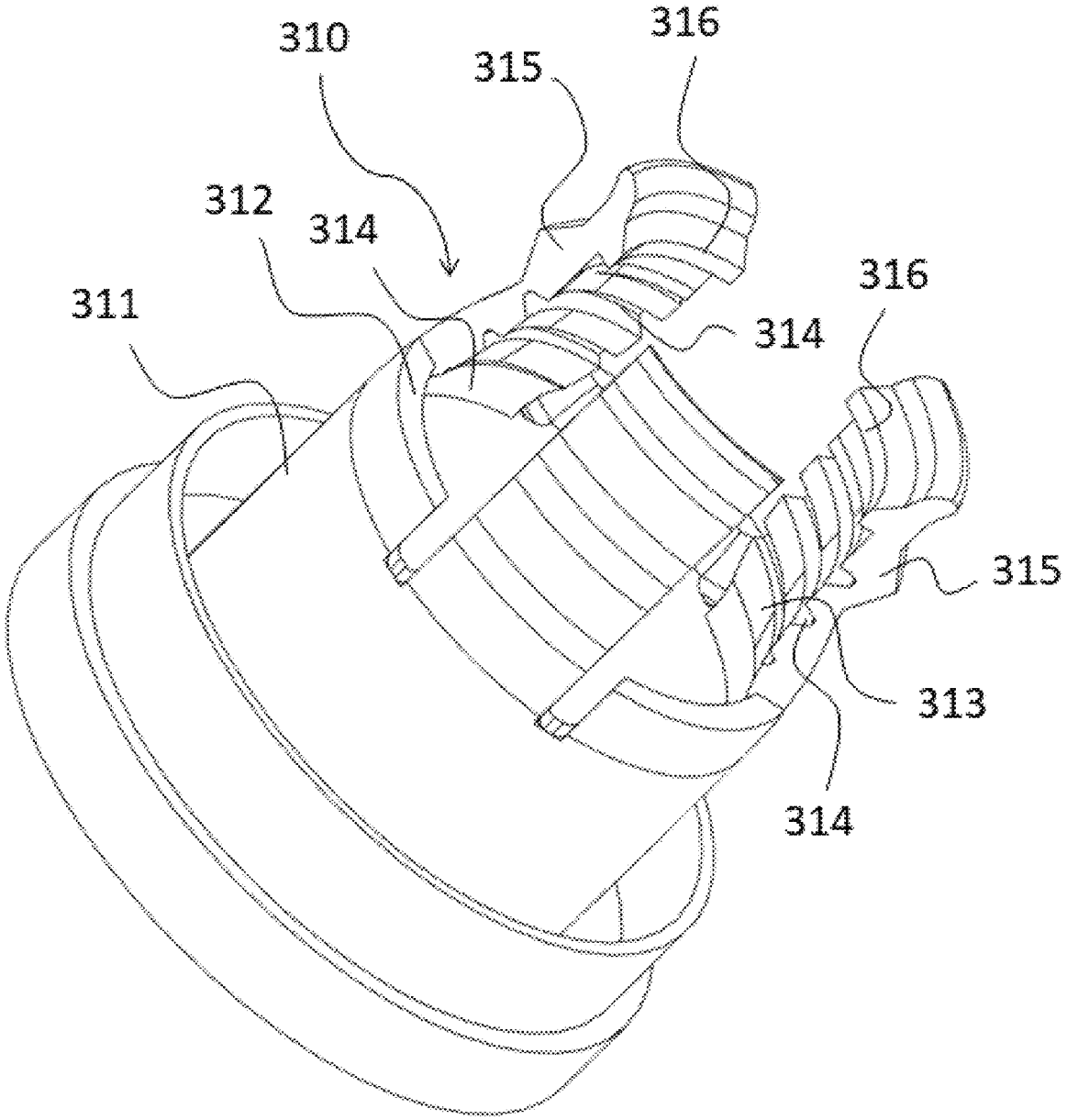
FIG. 13 is a perspective detail view of a first element of FIG. 12.
Figure 14:
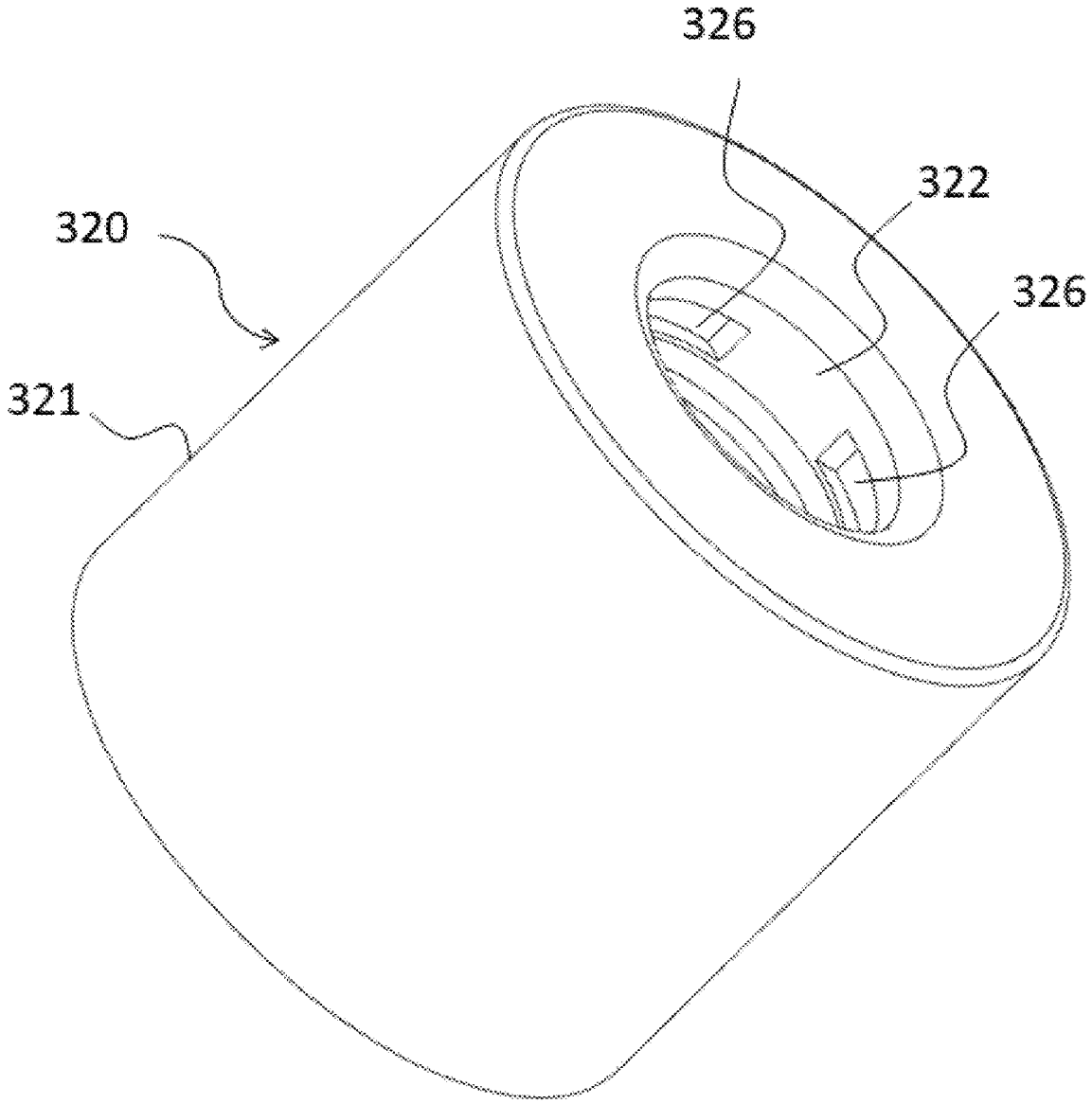
FIG. 14 is a perspective detail view of a second element of FIG. 12.
Figure 15:
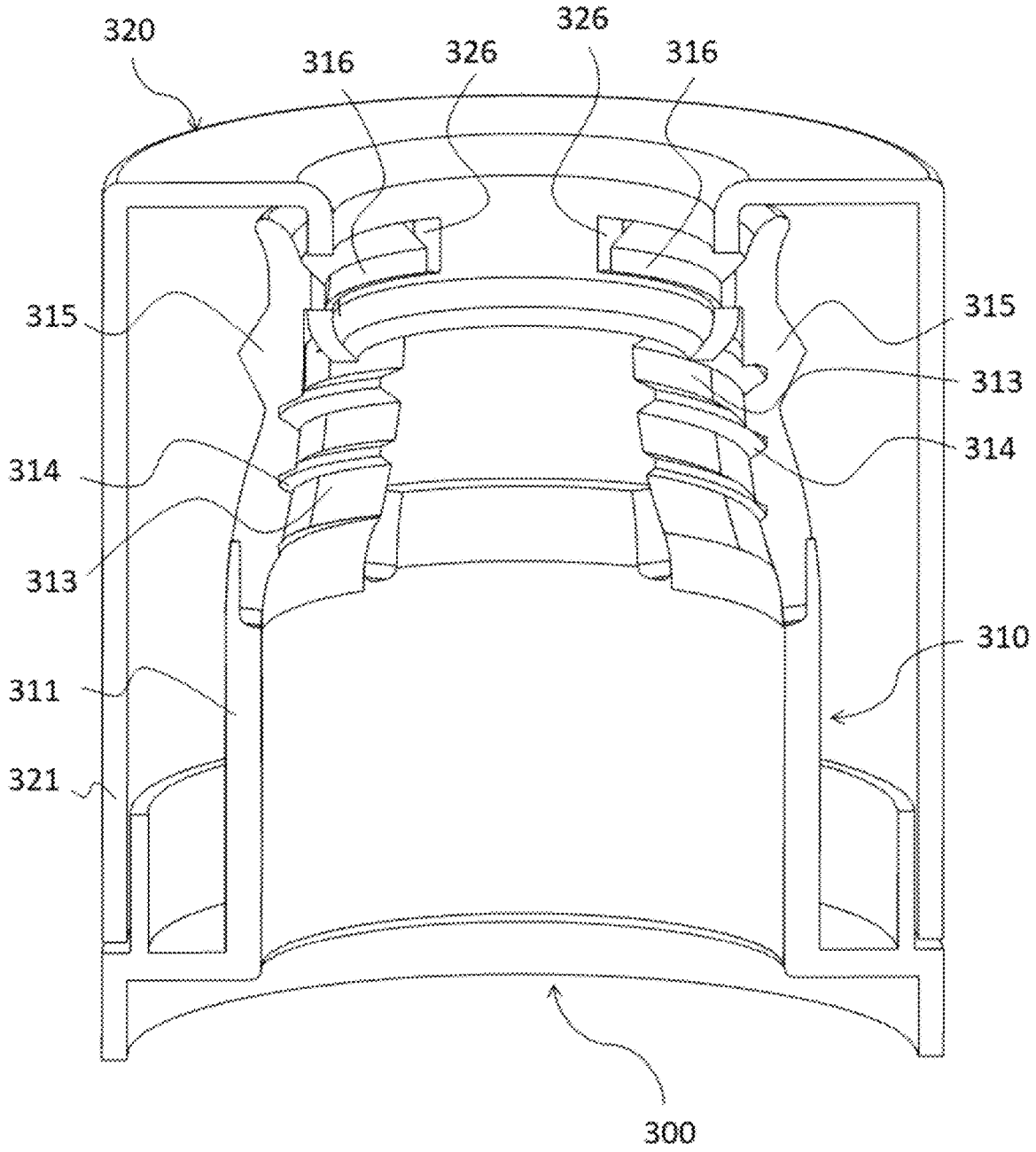
FIG. 15 is a longitudinal sectional view of the two elements of FIGS. 13 and 14 in an assembled position.

In accordance with FIGS. 13 and 15, the first element 310 also includes, on the inner wall 313 thereof at the radially elastically deformable tabs 315 (under the hooks), an internal thread 314 over a portion of the length thereof, said thread having a slight conicity such that it narrows radially as axially approaching the hooks 316.

Figure 16:
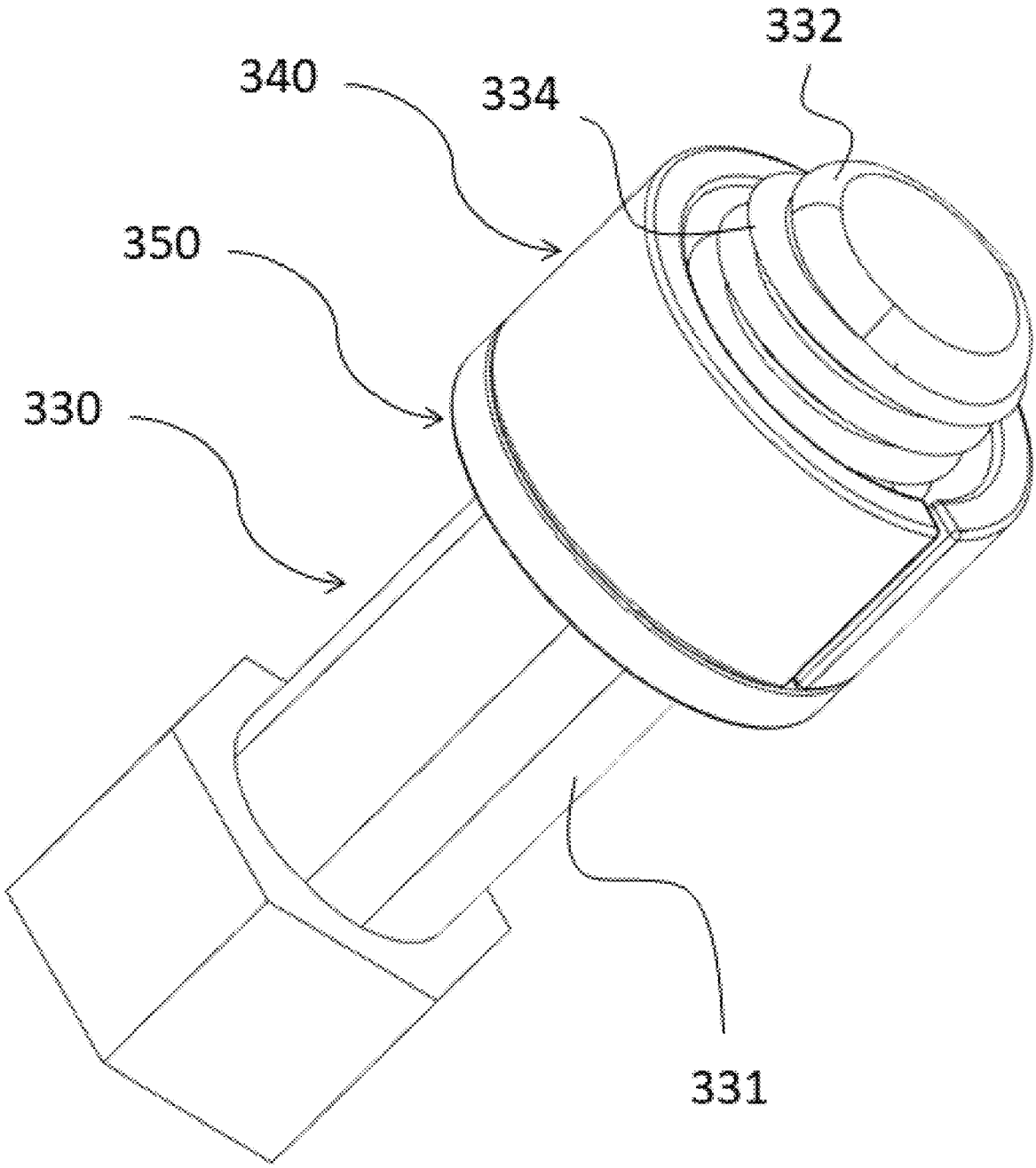
FIG. 16 is a perspective detail view representing at least one additional release means of FIG. 12.

The additional release means 330 includes, in turn, as illustrated in FIG. 16, a rod-shaped main body 331 provided, at a distal end 332, with an external thread 334 intended to cooperate with the internal thread 314 of the first element 310.

As previously, the assembly 300 also includes a metal weight element 340 and a magnet 350.

The operation of this third embodiment is as follows.

Once the cover 2 has been removed, the user or a machine places the additional release means 330 inside the internal element 310, then he rotates said additional release means 330 so as to screw it into said internal element 310 by interpenetration of the external 334 and internal 314 threads.

Figure 17:
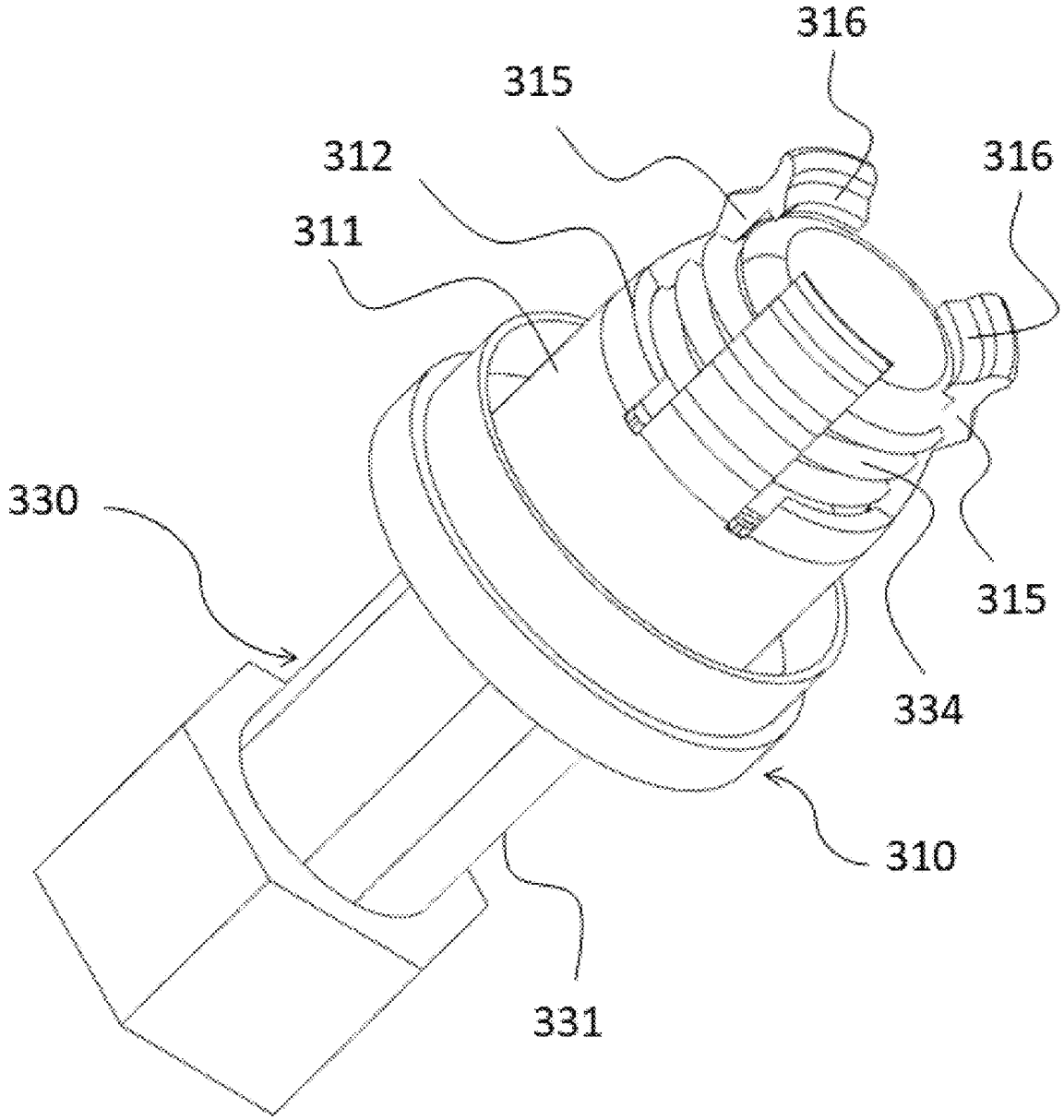
FIG. 17 is a perspective detail view of the additional release means of FIG. 16 inserted axially into the first element of FIG. 13.
Figure 18:
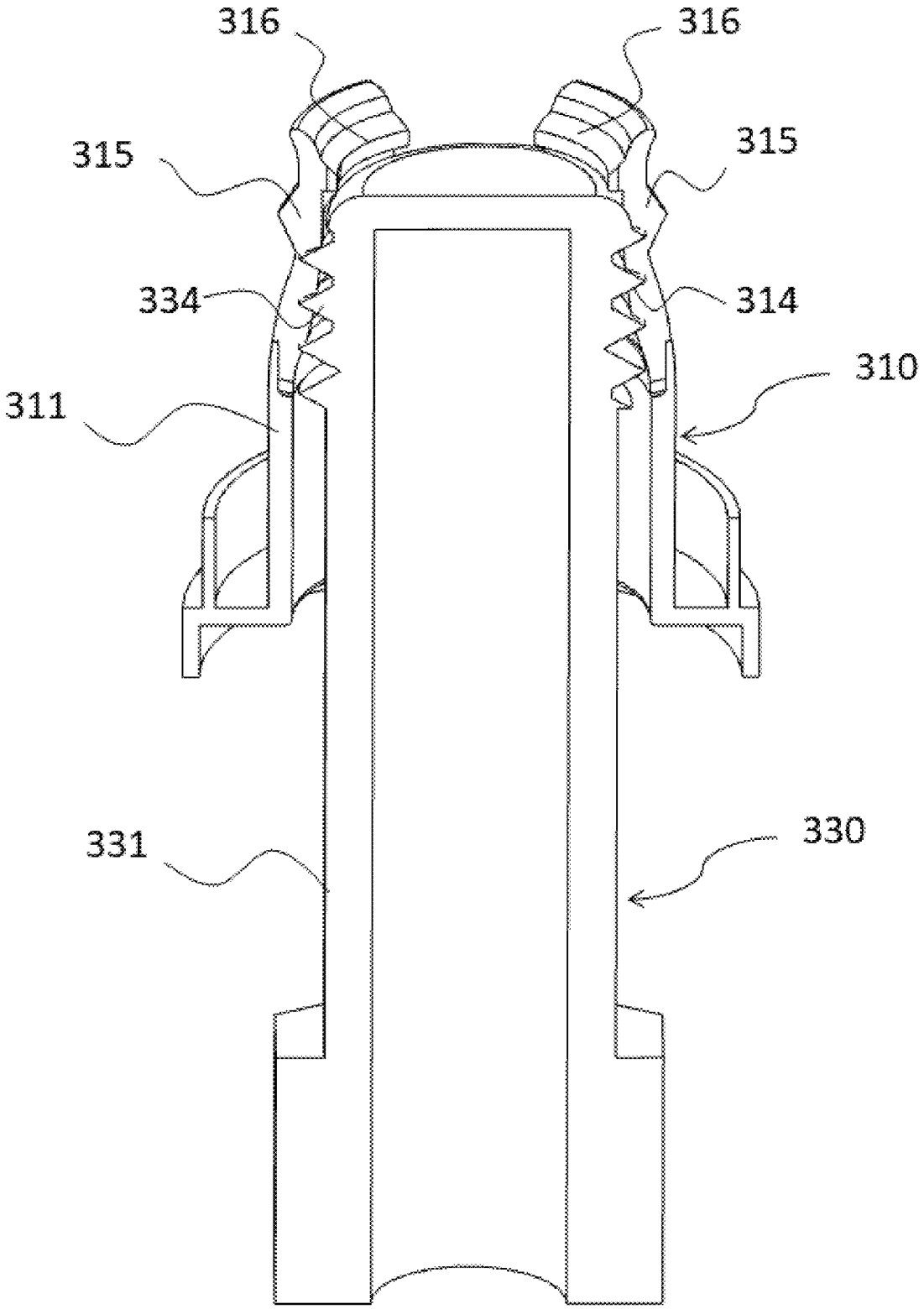
FIG. 18 is a longitudinal sectional view of FIG. 17.
Figure 19:
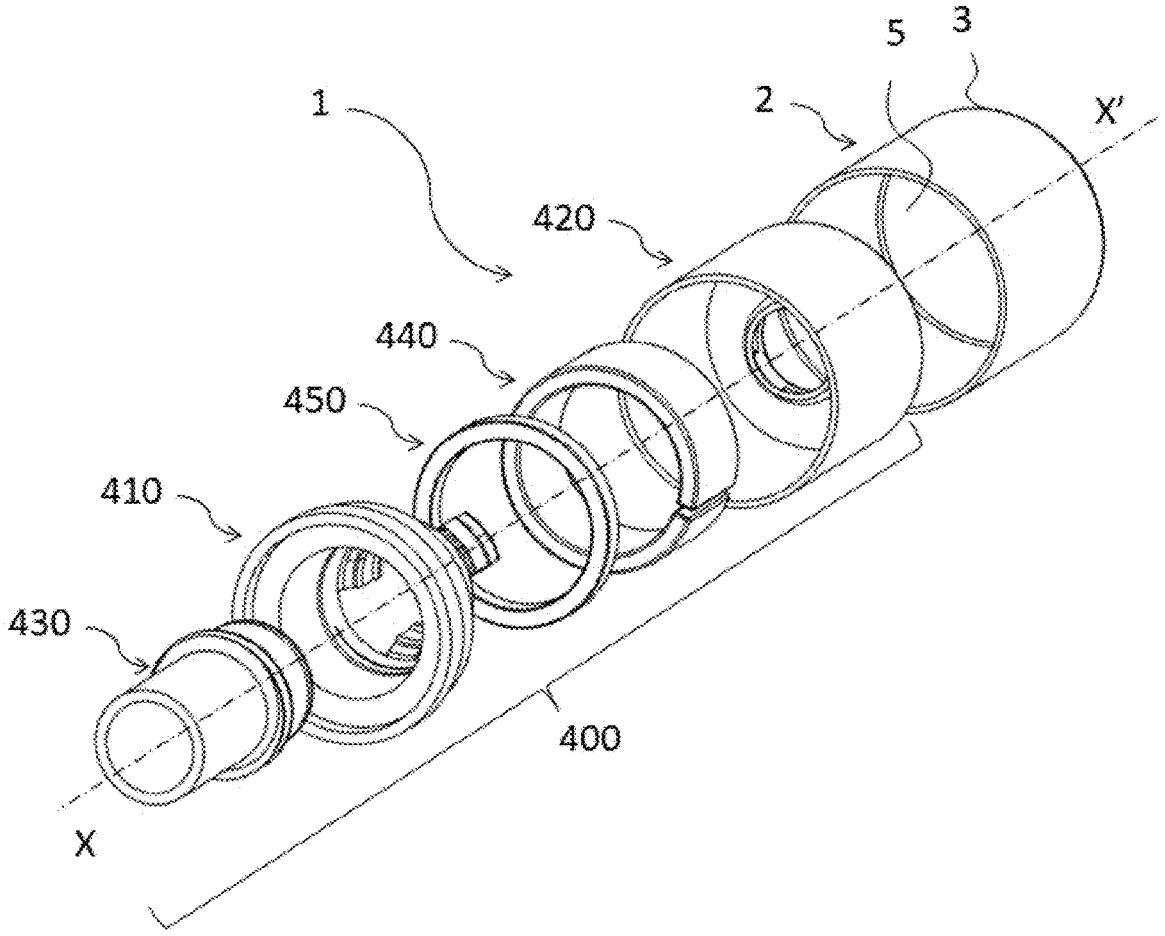
FIG. 19 is an exploded perspective view of a fourth embodiment of an assembly in accordance with the present invention.

During this rotation, the additional release means 330 gradually axially penetrates into the internal element 310 and the cooperation of the threads 334 and 314 cause the radially elastically deformable tabs 315 to be radially spaced apart from each other as the additional release means advances axially such that the hooks 316 are disengaged from the notches 326 of the external element 320 (see FIGS. 17 and 18). It is then possible to recover; on the one hand, the cover 2, the weight element, the magnet 350 and the external element 320 made of metal, and on the other hand, the internal element 310 and the additional release means 330 made of plastic material.

According to a fourth embodiment illustrated by FIGS. 19 to 25, the assembly 1 includes the cover 2 and an assembly 400 composed of an external element 410 made of aluminum, an internal element 420 made of plastic material, a metal weight element 440, a magnet 450 to fasten the assembly 1 around a prominent gas or pump propulsion system (not represented), and an external accessory 430 for releasing the two elements 410 and 420.

More specifically (see FIG. 20), the first element 410 generally comprises a main body 411 of essentially cylindrical shape extending along the axis XX' provided, at an upper rim 412, with three radially elastically deformable tabs 415 each provided with an end hook 416 protruding radially away from the axis XX'. The tabs 415 are evenly distributed (that is to say at 120°) over the periphery of the first element 410 and are spaced from each other by a longitudinal slot allowing the aforementioned elastic radial deformation.

The second element 420 (see FIG. 21) has, in turn, the overall shape of a hollow cylinder 421 extending along the axis XX' and including an upper edge 422 provided, on the inner periphery thereof, with blind notches 426 (three in number in the present case) evenly angularly distributed over the circumference of the edge 422 (that is to say at 120° from each other). It will be understood by observing the figures that the notches 426 are intended to be placed opposite the hooks 416 in the assembled position of the elements 110 and 120.

Figure 20:
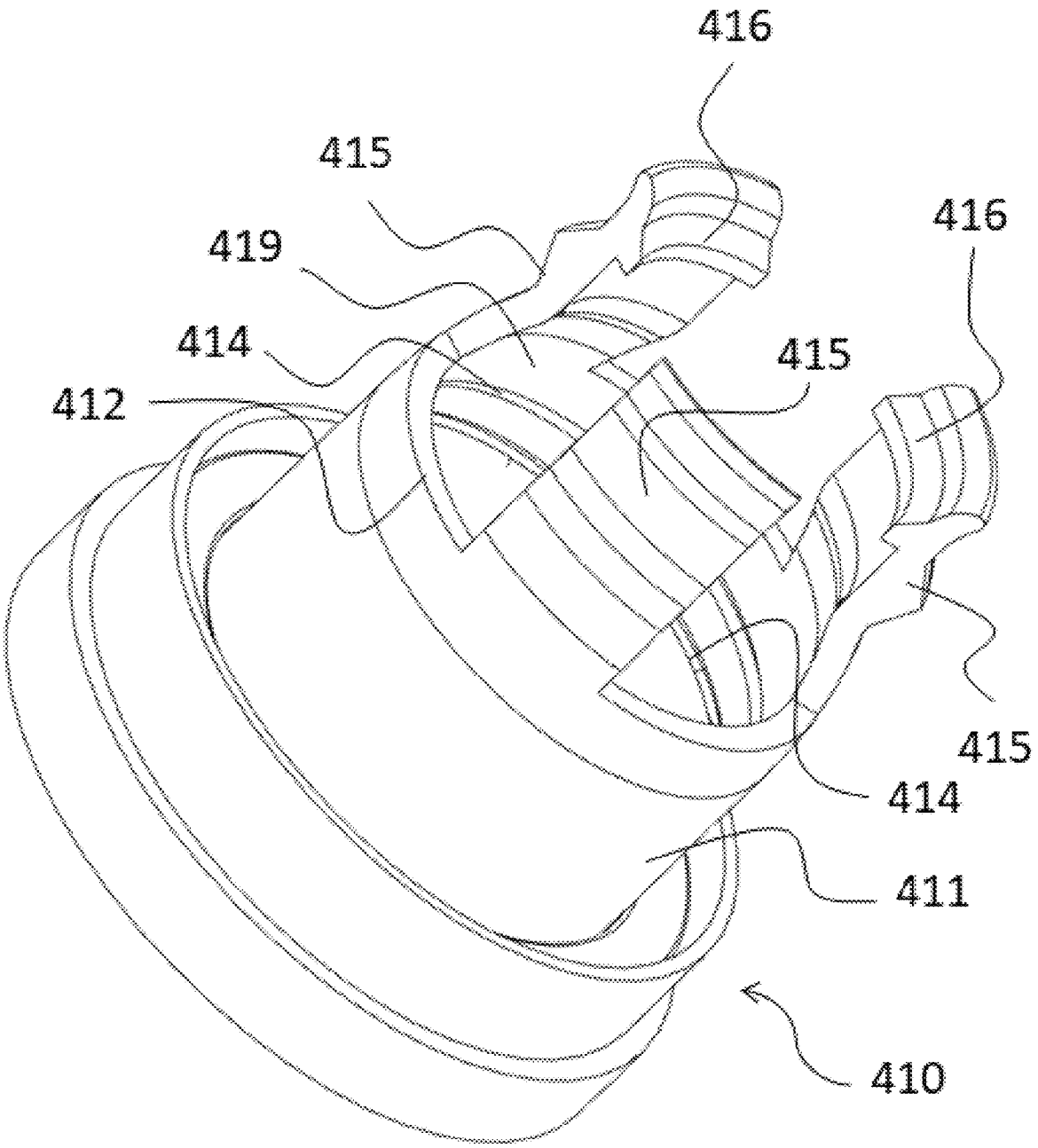
FIG. 20 is a perspective detail view of a first element of FIG. 19.
Figure 21:
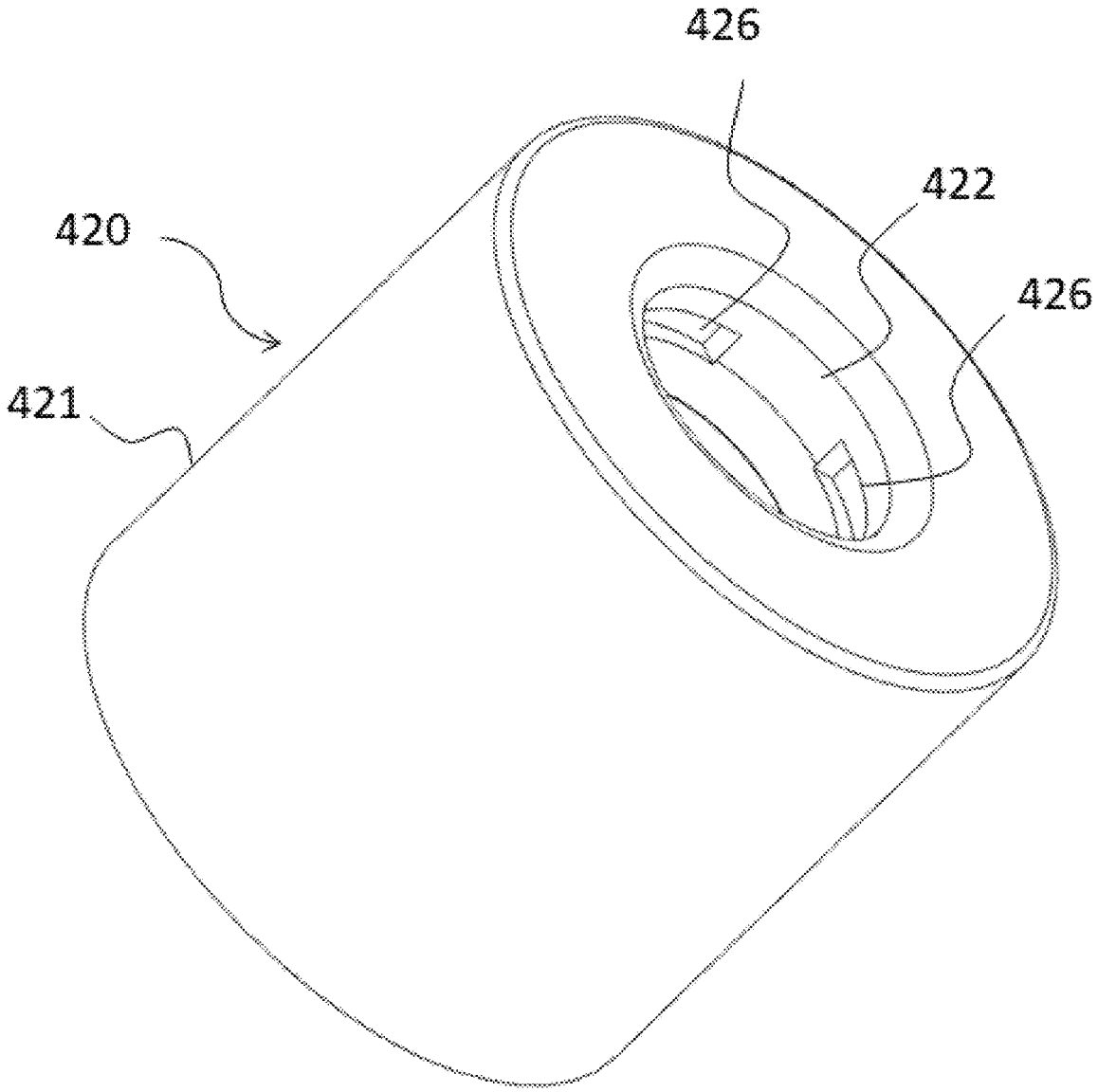
FIG. 21 is a perspective detail view of a second element of FIG. 19.
Figure 22:
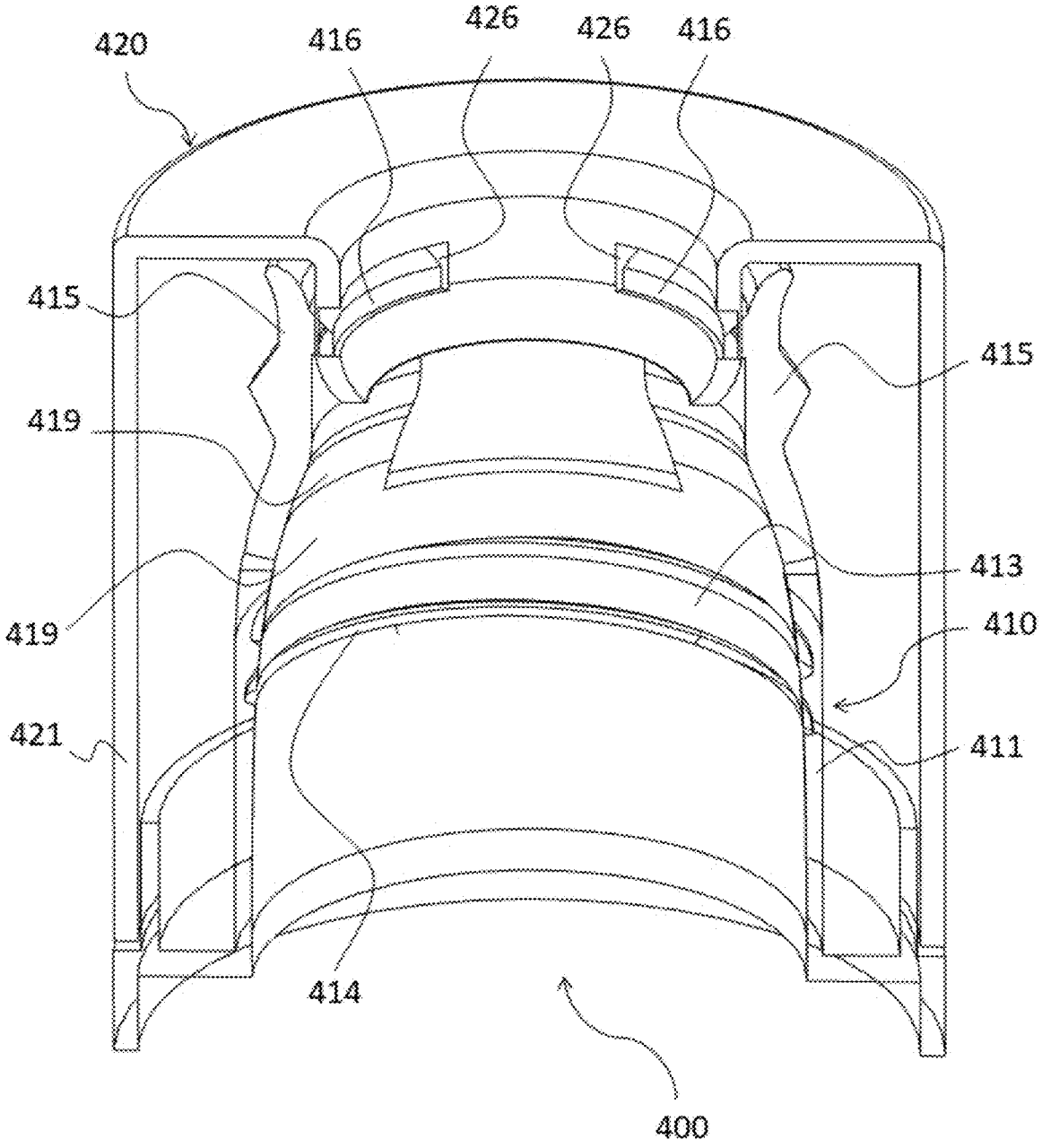
FIG. 22 is a longitudinal sectional view of the two elements of FIGS. 20 and 21 in an assembled position.
Figure 23:
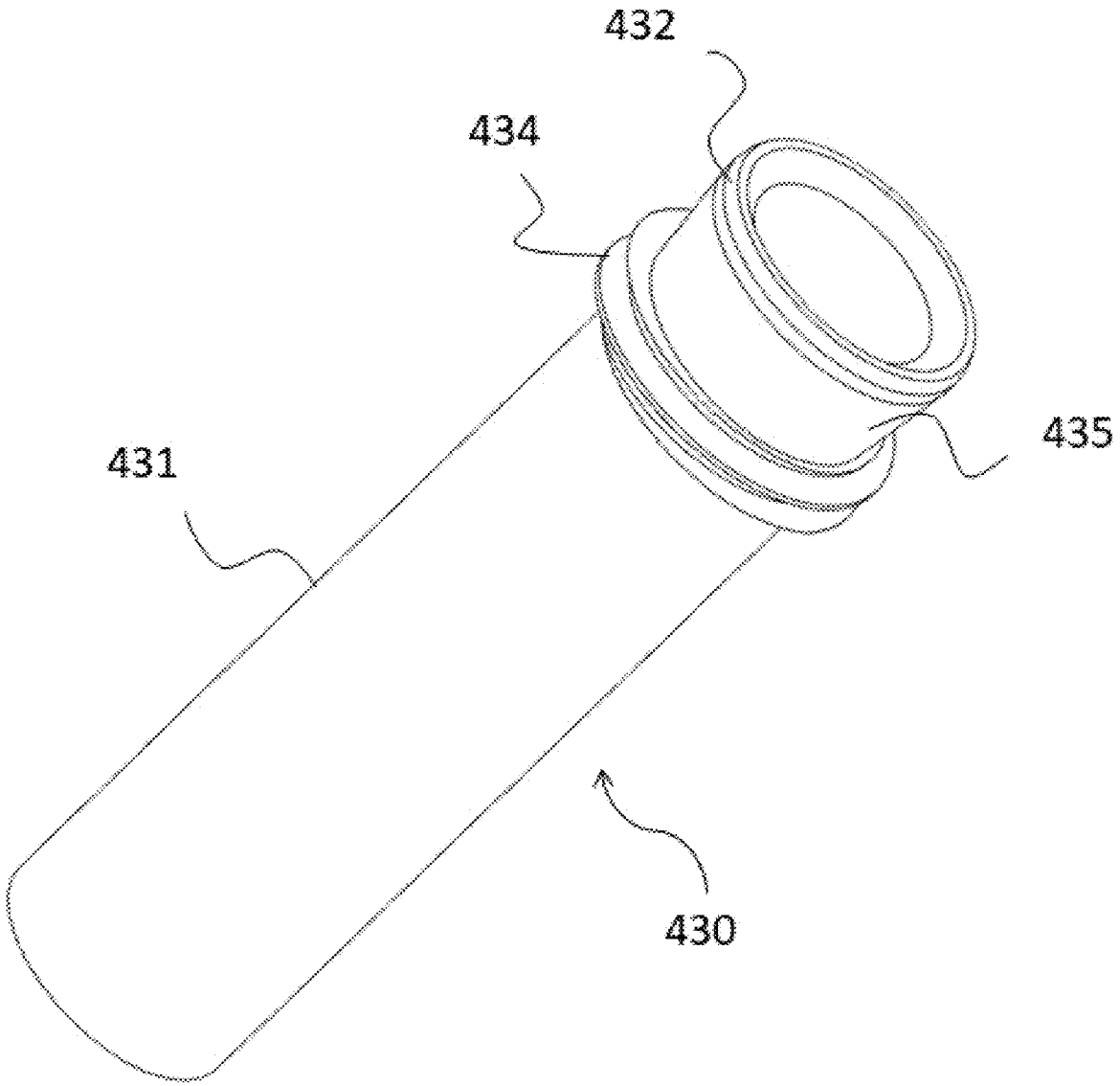
FIG. 23 is a perspective detail view of an additional release means of FIG. 19.
Figure 24:
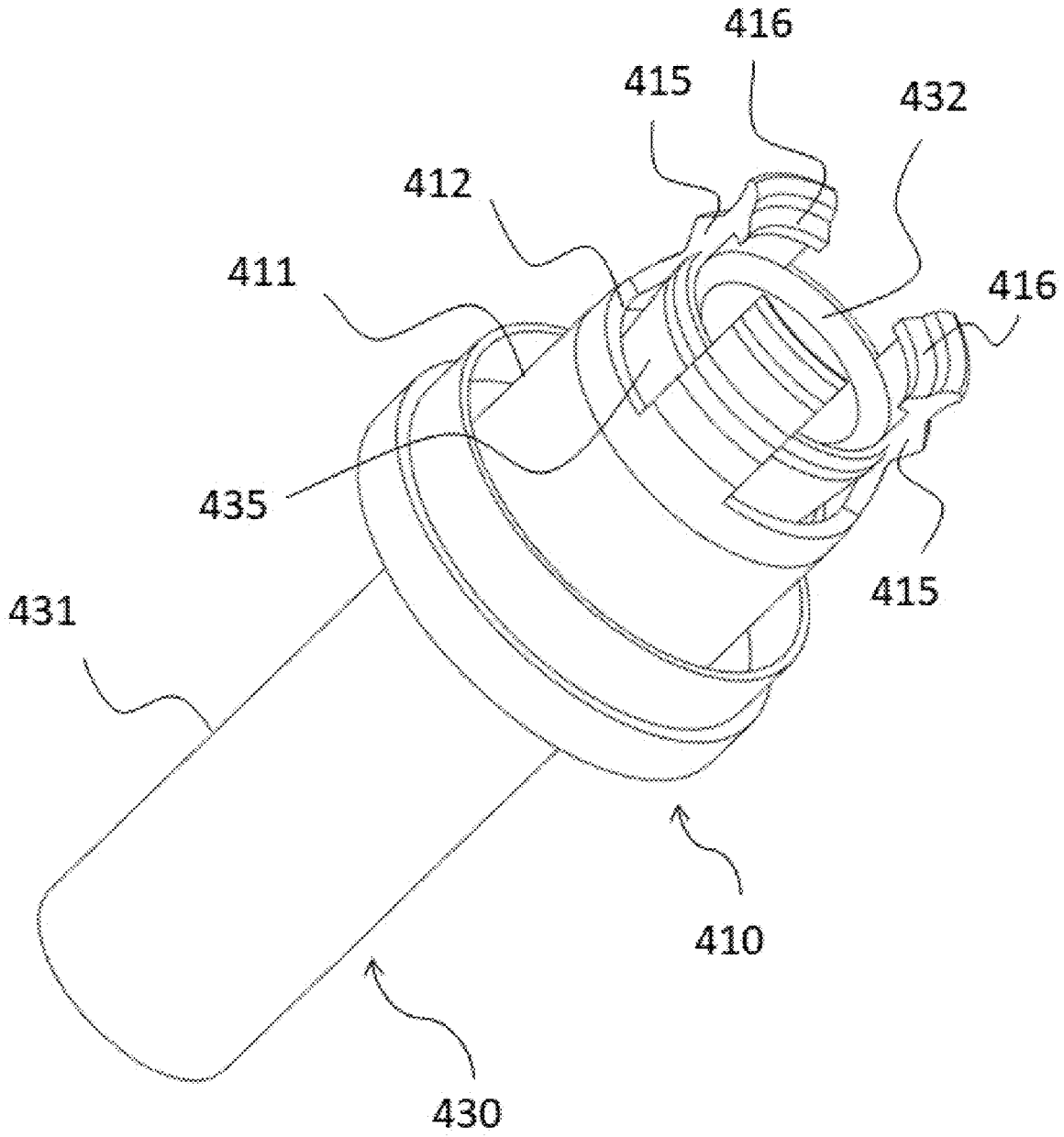
FIG. 24 is a perspective detail view of the additional release means of FIG. 23 inserted into the first element of FIG. 19.
Figure 25:
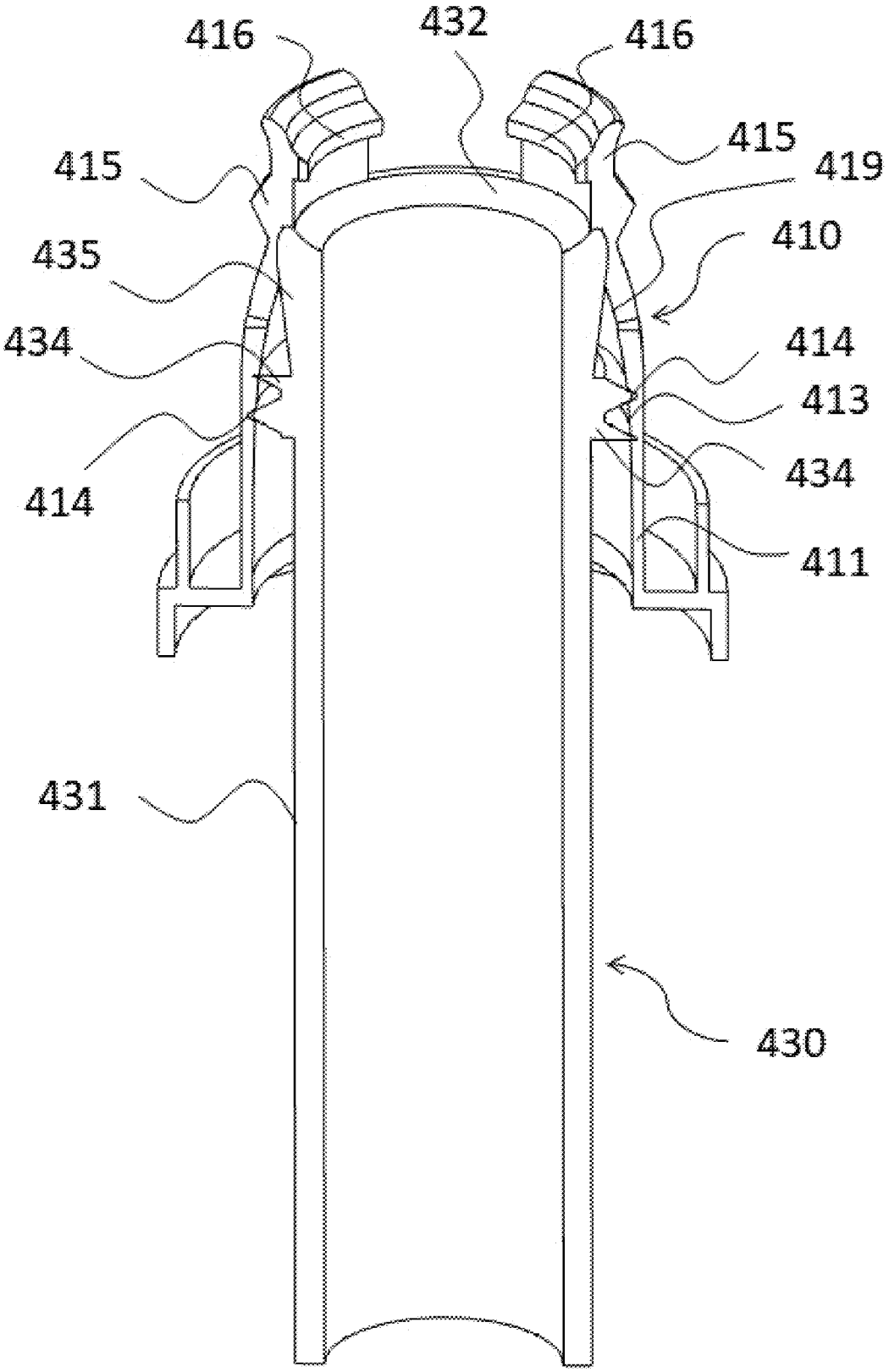
FIG. 25 is a longitudinal sectional view of FIG. 24.

In accordance with FIGS. 20 and 22, the first internal element 410 also includes, on the inner wall 413 thereof, on the one hand, an internal thread 414 at the main body 411, then, as axially approaching the hooks 416, at the radially elastically deformable tabs 15, a conical portion 419 narrowing radially as axially approaching the hooks 416.

Unlike the third embodiment, the thread 414 413 is straight and not conical. In this variant of the preceding embodiment, the additional release means 430 also includes, in addition to a rod 431 locally provided with an external thread 434 (2-3 threads for example), an enlarged head 435 located at the level a distal end 432 and intended to cooperate with the conical inner surface 419 of the first element 410.

Thus, as the external thread 434 is screwed into the internal thread 414 of the first element 410, and the additional release means 430 progresses axially in said first element 410, the enlarged head 435 moves away the radially elastically deformable tabs 415 such that the hooks 416 are gradually disengaged from the notches 426, which ultimately allows releasing the two elements 410 and 420 from each other.

It is then possible to recover and recycle independently the first element 410 and the additional release means 430 made of plastic material, on the one hand, and the outer cover 2, the second element 420, the weight element 440 and the magnet 450, on the other hand.

The four embodiments thus described are particularly effective to easily recycle portions which, ordinarily, were thrown away because they could not be released nor sorted depending on their material.

It should be understood that the detailed description of the subject of the invention, given only by way of illustration, does not, in any way, constitute a limitation, the technical equivalents also being included within the scope of the present invention. Thus, the number and the angular distribution of the radially elastically deformable tabs, hooks and notches can vary.

The notches may open through the wall of the second element.

The invention claimed is:

1. An assembly forming a cap for a container of a cosmetic product, the assembly having a longitudinal axis, comprising:

a first element, extending along the longitudinal axis, adapted to be mounted on the container;

a second element detachably assembled around the first element;

wherein the first element comprises radially elastically deformable tabs configured to assemble the second element on the first element, the radially elastically deformable tabs configured to be radially engaged with notches formed inside the second element in an assembled position; and a release element movable between a rest position in which the radially elastically deformable tabs of the first element are engaged with the notches of the second element to assemble the first element and the second element, and an active position in which the radially elastically deformable tabs are disengaged radially from the notches to disassemble the first element with the second element.

2. The assembly of claim 1, wherein the release element has magnetic properties which is configured to be displaced under an effect of a predetermined external magnetic field, the release element being axially movable between the rest position when it is placed outside the determined external magnetic field and the active position to disengage the radially elastically deformable tabs from the notches when the release element is placed in the predetermined external magnetic field.

3. The assembly of claim 2, wherein the radially elastically deformable tabs comprise peripheral hooks configured to penetrate into the notches of the second element, the radially elastically deformable tabs further comprise central fingers, secured to the radially elastically deformable tabs and wherein the release element is a ring-shaped magnet disposed around the central fingers and having a conical outer surface, the central fingers radially bring together the radially elastically deformable tabs, with respect to the longitudinal axis, when the ring-shaped magnet passes from the rest position to the active position, thereby disengaging the peripheral hooks out from the notches.

4. The assembly of claim 3, further comprising three central fingers, three notches and three radially deformable tabs, all of them being evenly distributed angularly.

5. The assembly of claim 1, wherein the release element is an axially movable tool inside the first element between a rest position and an active position, the release element being configured to disengage the radially elastically deformable tabs from the notches.

6. The assembly of claim 5, wherein the radially elastically deformable tabs comprise at their free ends thereof, peripheral hooks configured to penetrate into the notches of the second element, the radially elastically deformable tabs being secured to an inner wall of the first element, the inner wall being reduced in a direction of the radially elastically deformable tabs; and wherein the axially movable tool is a rod comprising radial protuberances at one working end, an axial displacement of the axially movable tool along the inner wall of the first element by the radial protuberances causes a radial spacing of the radially elastically deformable tabs and a disengagement of the peripheral hooks out from the notches.

7. The assembly of claim 6, wherein the first element comprises, along the inner wall thereof, grooves to insert and axially guide the radial pushers towards the peripheral hooks.

8. The assembly of claim 6, further comprising three radial pushers, three notches and three radially elastically deformable tabs, all of them being evenly distributed angularly.

9. The assembly of claim 1, wherein the first element comprises an internal thread and wherein the release element is a rod comprising an external thread, the external thread of the rod being configured to engage the internal thread of the first element and be screwed in thereof, between a rest position and an active position to gradually disengage the radially elastically deformable tabs from the notches of the second element as a screwing of the rod progresses into the first element.

10. The assembly of claim 9, wherein the rod further comprises an enlarged end head configured to bear against a conical inner wall of the first element carrying the radially elastically deformable tabs, the radially elastically deformable tabs being radially spaced apart from each other by the enlarged end head bearing against the conical inner wall as the screwing of the rod progresses into the first element.

11. The assembly of claim 1, wherein the notches are blind notches.

12. The assembly of claim 1, wherein the notches are through holes.

* * * * *